US009375037B1

(12) United States Patent
Clark

(10) Patent No.: US 9,375,037 B1
(45) Date of Patent: Jun. 28, 2016

(54) ADJUSTABLE INFANT CARRYING GARMENT FOR OUTDOOR WEAR

(71) Applicant: Sarah Clark, New York, NY (US)

(72) Inventor: Sarah Clark, New York, NY (US)

( * ) Notice: Subject to any disclaimer, the term of this patent is extended or adjusted under 35 U.S.C. 154(b) by 178 days.

(21) Appl. No.: 14/055,432

(22) Filed: Oct. 16, 2013

Related U.S. Application Data

(63) Continuation-in-part of application No. 29/469,557, filed on Oct. 11, 2013.

(60) Provisional application No. 61/714,483, filed on Oct. 16, 2012.

(51) Int. Cl.
*A47D 13/00* (2006.01)
*A41D 15/00* (2006.01)
*A47D 13/02* (2006.01)

(52) U.S. Cl.
CPC ..... *A41D 15/00* (2013.01); *A47D 13/00* (2013.01); *A47D 13/025* (2013.01)

(58) Field of Classification Search
CPC ..... A47D 13/00; A47D 13/025; A41D 15/00
USPC ..... 2/102, 104, 106–108, 111, 114, 118, 2/85, 88, 93–94, 115, 69, DIG. 1; 224/158–161, 576; 119/496–497
See application file for complete search history.

(56) References Cited

U.S. PATENT DOCUMENTS 5,946,724 A 9/1999 Erickson
6,328,618 B1 * 12/2001 Fleischli ..... 441/106
6,618,863 B2 * 9/2003 Blechman ..... 2/311
D529,687 S 10/2006 Rindle
7,117,538 B2 10/2006 Bosne et al.
7,171,695 B2 2/2007 Braun
D555,878 S 11/2007 Bay
D588,783 S 3/2009 Olstorn
D598,639 S 8/2009 Holder
7,926,448 B2 * 4/2011 Fox ..... 119/497
7,966,668 B2 * 6/2011 Bay ..... 2/93
2003/0051286 A1 3/2003 Gregg
2004/0133962 A1 7/2004 Baumel
2004/0237168 A1 12/2004 Braun
2005/0015844 A1 * 1/2005 Parsons ..... 2/94
2005/0235392 A1 * 10/2005 Bay ..... 2/93
2006/0206978 A1 * 9/2006 Hilton et al. ..... 2/104
2008/0005825 A1 1/2008 Tronvold
2009/0249529 A1 10/2009 Rodriguez et al.
2010/0107300 A1 5/2010 Yiu
2010/0320241 A1 * 12/2010 Thompson ..... 224/153
2012/0060256 A1 * 3/2012 Parker ..... 2/85
2012/0096622 A1 * 4/2012 Johnson ..... 2/93
2013/0284783 A1 * 10/2013 Burpee ..... 224/576
2013/0318678 A1 * 12/2013 Poucher ..... 2/79

* cited by examiner

*Primary Examiner* — Khaled Annis

(74) *Attorney, Agent, or Firm* — Charles N. Quinn; Fox Rothschild LLP

(57) ABSTRACT

A garment for outdoor wear, having a central portion adapted to fit about an adult's torso, the central portion comprising respective side panels; sleeves extending downwardly from the upper extremity of the central portion, to accommodate the arms of a person wearing the garment; and size-adjusting closures extending from the lower extremity of the central portion upwardly under the sleeves.

21 Claims, 33 Drawing Sheets

ADJUSTABLE INFANT CARRYING GARMENT FOR OUTDOOR WEAR

CROSS-REFERENCED TO RELATED UNITED STATES PATENT APPLICATIONS

This patent application claims the benefit of the priority of U.S. provisional application Ser. No. 61/714,483 filed 16 Oct. 2012 in the name of Sarah Clark and entitled "Adjustable Size Garment for Outdoor Wear." The priority is claimed under 35 USC 119 and 35 USC 120. This patent application is a continuation-in-part of U.S. design application Ser. No. 29/469,557 for a "Adjustable Garment for Outdoor Wear" filed 11 Oct. 2013 in the name of Sarah Clark, which application also claimed priority from the '483 provisional application; this application claims priority from not only the '483 provisional application, but also from the '557 application filed on 11 Oct. 2013. The priority of the '557 application is claimed under 35 USC 120.

SUMMARY OF THE INVENTION

In one of its many aspects, this invention provides an adjustable size garment for outdoor wear. The garment is especially adapted for wear by adults, especially those adults carrying accompanying infants, with a portion of the garment being especially adapted to optionally fit around an infant carried on the torso of an adult wearing the garment.

The adjustable size garment preferably includes a central portion adapted to fit about an adult's torso. The central portion generally includes a front part, left and right side parts and a rear part.

The adjustable size garment may further preferably include a detachable hood which is preferably snap-attached to an upper part of the central portion. The detachable hood is adapted to fit around the head of an adult wearing the garment.

The adjustable size garment desirably includes a drawstring positioned within a fabric tunnel running circumferentially around the lower extremity of the central portion. The drawstring works to secure the central portion lower extremity about the torso of an adult wearing the garment.

A main zipper runs generally vertically, is fitted in a front part of the central portion of the adjustable size garment, and serves to optionally secure together generally vertically extending edges of the central portion. The main zipper extends upwardly preferably from the lower extremity of the central portion preferably to a position about midway between the lower extremity and an upper extremity of the central portion, where snap closures commence and run up to the collar of the garment, to secure the upper part of the front part and the collar optionally partially or completely closed.

The snap closures are particularly suitable for this garment when the wearer of the garment chooses to carry a small child within the garment. The snap closures allow the garment to be closed snuggly around the infant's neck or even the infant's face without the danger of irritation or chafing of the infant's skin, which would otherwise be present were zippers used to close the upper portion of the garment.

The adjustable size garment further preferably includes such a collection of snap closures. These snap closures serve to detachably secure together the generally vertically extending edges of the central portion and extend from a position about midway between the lower extremity of the central portion and the upper extremity of the central portion where the main zipper terminates, up to a position proximate an upper extremity of the upper portion.

The adjustable size garment further preferably includes a pair of closable generally vertically extending apparent openings in the outer cloth of respective side parts of the central portion. Pairs of left and right side vertically extending bisecting zippers are preferably attached to edges of the respective closable vertically extending openings. Each of the left and right side extending vertically bisecting zippers is preferably adapted to be manually substantially vertically moved to eliminate horizontal separation between respective inter-engaging portions of the zippers, thereby to tighten or to loosen the central portion of the garment about the torso of an adult wearing the garment. These vertically extending bisecting zippers are preferably of the "invisible" type, such that when the zippers are closed, only the pull for the zipper is visible.

The adjustable size garment preferably further includes zippered pockets on each arm of the garment.

The garment preferably further includes left and right front panel lower zippers, which provide openings to pockets located within the garment, and left and right panel upper zippers that provide openings to the garment interior. The left and right front panel lower zippers and left and right front panel upper zippers are essentially vertically aligned. The left and right front panel upper zippers close generally vertically extending openings in the respective front parts of the central portion, which openings are suitably adapted for passage therethrough of an infant or small child's arms when the infant or small child is carried by an adult, with the infant or small child within the garment upper portion, so that the infant or small child is carried generally on the torso, particularly on the upper chest or breast, of the adult. The closeable, generally vertically openings in the respective front parts of the central portion allow the infant's arms to protrude, thereby providing a posture of greater comfort for the infant while the infant is being carried by the adult.

In another one of its aspects, this invention provides an adjustable size garment for outdoor wear by adults, especially adapted for those adults carrying accompanying infants, with a frontal portion of the garment being adjustably enlargeable to fit around an infant carried on the upper torso of an adult wearing the garment.

In this aspect of the invention, the garment preferably includes a central portion adapted to fit about an adult's torso, with the central portion generally having a front part comprising left and right exterior panel side parts comprising respective left and right side exterior panels, and a back part comprising a back panel. The garment further preferably includes a drawstring positioned within a circumferential fabric tunnel located at the lower extremity of the central portion for securing the central portion lower extremity about the torso of an adult wearing the garment.

The garment in this aspect of the invention yet further preferably includes a front zipper fitted in a front part of the central portion. The front zipper serves to optionally secure together generally vertically extending edges of the left and right front exterior panels of the central portion. The front zipper preferably extends from the lower extremity of the central portion to a position generally midway between the lower extremity of the central portion and an upper extremity of the central portion.

In one embodiment of the invention, the garment further preferably includes a collection of snap closures for detachably securing together generally vertically extending edges of the left front and right front exterior panels of the central portion. The snap closures are preferably located between the upper extremity of the front zipper and an upper extremity of the central portion. The garment preferably further includes a pair of sleeves extending downwardly from the upper extremity of the central portion to accommodate the arms of the person wearing the garment.

Size adjusting zippers are provided in the form of left and right side panel bisecting zippers extending from the lower extremity of the central portion upwardly under the sleeves nearly to juncture of the respective sleeve and the central portion. These size adjusting zippers permit adjustment of the size of the garment around the girth of the adult wearing the garment. Linings are provided connected to the central portion. The linings are connected interior of the size-adjusting left and right side panel bisecting zippers, on both sides of respective ones of the size-adjusting left and right side panel bisecting zippers. The linings are preferably of a preselected width to control the extent to which a garment may be size adjusted to accommodate adults of varying size by raising or lowering the size-adjusting zippers. The linings are preferably fabric, most preferably elastic.

DESCRIPTION OF THE PREFERRED EMBODIMENTS

Figure 1:
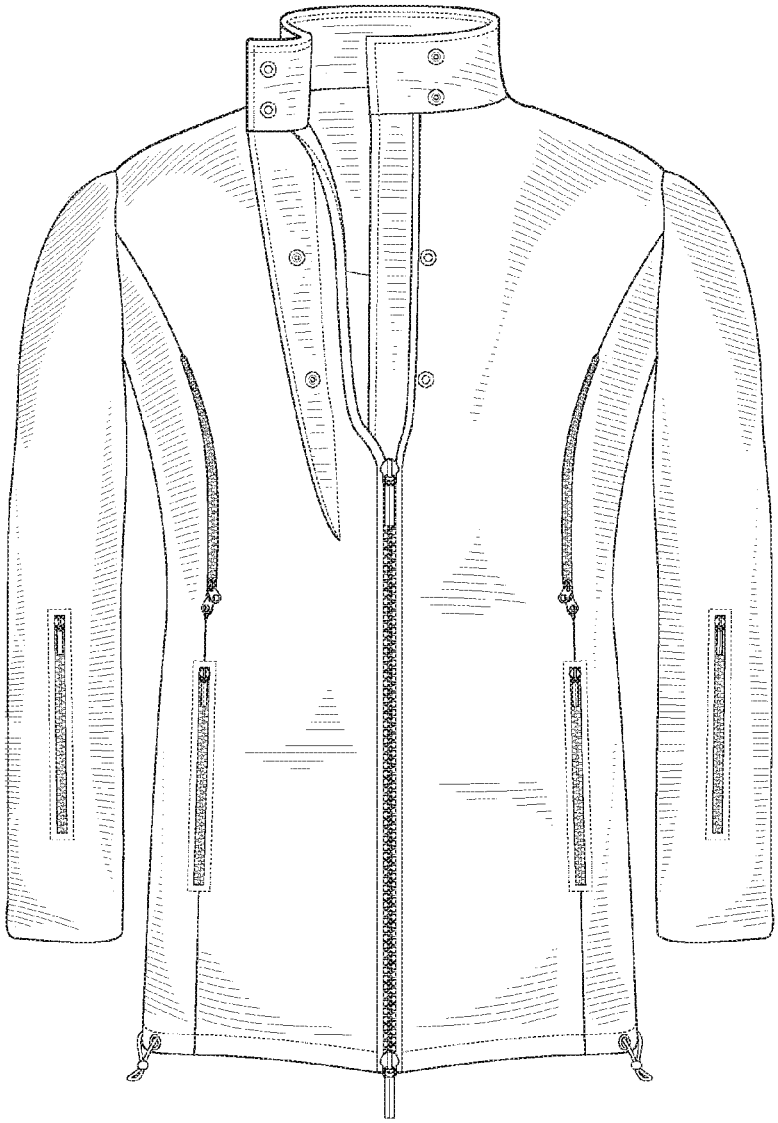
FIG. 1 is a front elevation of one preferred embodiment of a garment embodying the invention with the front zipper closed but the front snap closures open.

As regarding nomenclature used in describing the invention, when using the terms "left" and "right", reference should be made to the garment as illustrated in FIG. 1. The "left" side of the garment is the left side as the garment as worn. Consequently, the "left" side of the garment appears on the right in FIG. 1, and the "right" side of the garment appears on the left in FIG. 1.

Referring to the drawings in general, and to FIGS. 1 through 16 in particular, a garment manifesting aspects of the invention is designated generally 10 and includes a collar designated 12 with the collar having collar snaps 14 for securing the two portions of the collar together. The collar and collar snaps are best illustrated in FIG. 1. Each pair of collar snaps 14 has a male portion and a female portion; male portions of collar snaps 14 are denoted "14M" whereas female portions of collars snaps 14 are denoted "14F." The garment further includes a rear neck cover panel designated 16 and a back panel designated 18, both best illustrated in FIG. 2.

The garment further includes a left side exterior panel designated generally 20, and a left front panel designated generally 26, both illustrated in FIG. 1.

The garment further includes a right front exterior panel 56 and a right side exterior panel 50. The garment is generally symmetrical about a vertical axis such that right side exterior panel 50 corresponds generally to left side exterior panel 20 and right front exterior panel 56 corresponds generally to left front exterior panel 26, with the exterior panel pairs 50, 20 and 56, 26 being essentially mirror images one of another in shape. When sewn together, left and right front exterior panels 26, 56, left and right side exterior panels 20, 50, and back panel 18, together with rear neck cover panel 16 and collar 12, form the exterior body portion of the garment of the invention.

In the drawings, seams joining two pieces of cloth are denoted by solid lines. One such seam, where rear neck cover panel 16 joins back panel 18, is seam 100 illustrated in FIG. 2. Straight stitching joining adjacent pieces of fabric to form a seam, such as seam 100, is depicted by dotted lines in the drawings; one such set of stitching forming a seam 102 between back panel 18 and right front exterior panel 56 is designated 104 in FIG. 2. Overlock stitching is denoted by closely spaced loops, such as stitching 226 in FIG. 14.

In the drawings, not all seams have been numbered to enhance drawing clarity. Similarly in the drawings, stitching such as stitch line 104 has not completely been illustrated to enhance drawing clarity.

A front zipper 36 is provided to releasably secure left front exterior panel 26 to right front exterior panel 56 as desired by the garment wearer. A set of front snaps, each of which snaps has been designated 38, is provided, with front snaps 38 located about forty percent of the way from collar 12 to the lower margin of the garment. Front snaps 38 are spaced vertically along vertically extending margins of left front exterior panel 26 and right front exterior panel 56.

Front snaps 38 are conventional and consist in each case of a mating male and female pair. The drawings depict the male and female pairs of each snap schematically; each of front snaps 38 has a male member and a female member comprising the snap 38; female members of snaps 38 are denoted "38F" while male members of snaps 38 are denoted "38M." While garment 10 has been depicted with two pairs of front snaps 38 located in spaced apart relation along the margins of left front exterior panel 26 and right front exterior panel 56, it is to be understood that the number of front snaps 38 that are used may depend on the size in which the garment is constructed, and the desire of the wearer for more or less closure as between left front exterior panel 26 and right front exterior panel 56.

Garment 10 further includes left and right sleeves designated generally 48 and 68 respectively, with each sleeve having an outwardly facing portion and an inwardly facing portion that is more proximate to the garment and to the body of the wearer. An outer portion of right sleeve 68 is denoted 80, while an inner portion of right sleeve 68 is denoted 82. An outer portion of left sleeve 48 is denoted 84, while an inner portion of left sleeve 48 is designated 86.

Figure 12:
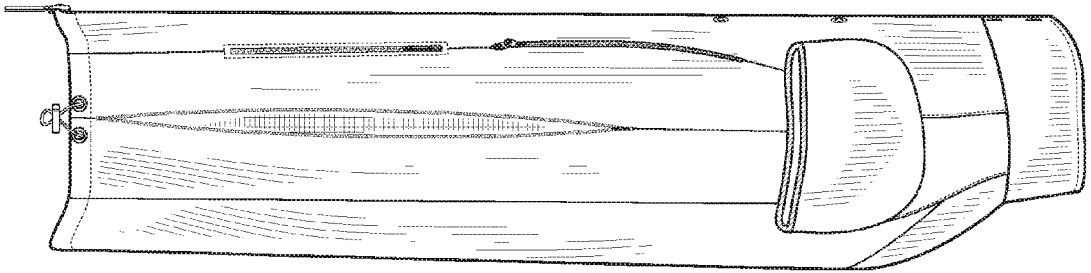
FIG. 12 is a right side elevation of the garment illustrated in FIGS. 1 through 11 with the right sleeve cut away and with the right side panel bisecting zipper open, exposing a right expansion panel to view.
Figure 13:
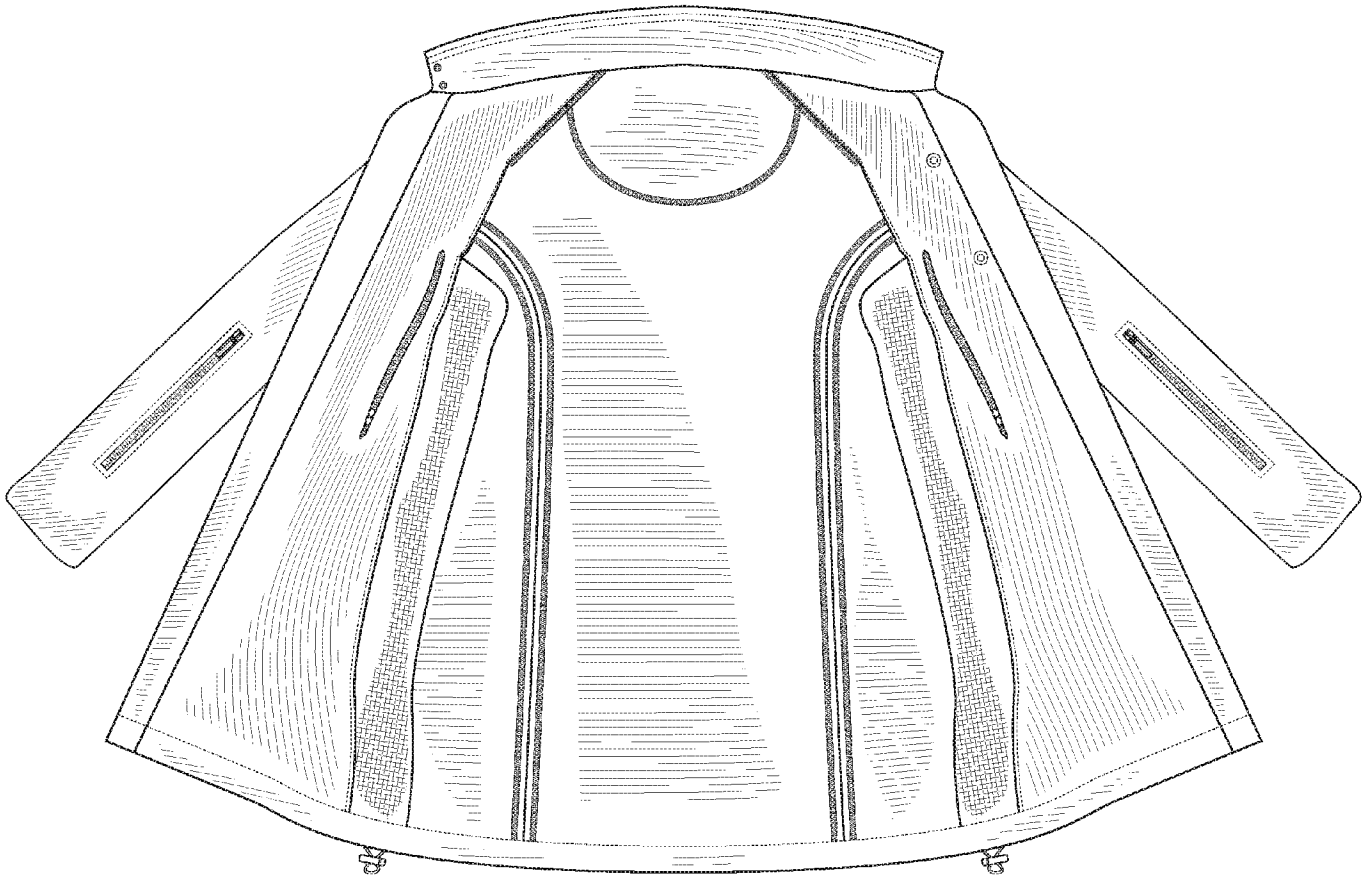
FIG. 13 is a left side elevation of the garment illustrated in FIGS. 1 through 12 with the left sleeve cut away and with the left side panel bisecting zipper open, exposing a left expansion panel to view.

Garment 10 further includes side zippers extending upwardly from the bottom margin of the garment, essentially bisecting the respective exterior side panels 20, 50 and terminating below the arm hole for the respective sleeve. These panel bisecting zippers are designated 150, 152 respectively and are illustrated in FIGS. 12 and 13. A seam 200 joins left side exterior panel 20 and rear exterior panel 18. Another seam 202 joins right side exterior panel 50 and rear exterior panel 18. The seam joining outer and inner portions 80, 82 of right sleeve 68 is designated 204. The seam joining outer and inner portions 84, 86 of left sleeve 48 is designated 206.

The following table presents a correlation between the drawing figures of the patterns used to create the garment in a preferred embodiment, the pattern piece name and the approximate measurements of the pattern piece in inches, as well as the number of each of the pattern pieces required for fabrication of the garment. The sizes given for the pattern pieces produce a garment of size "medium" for an average adult female. In the table detailing the patterns and drawing figures as set forth below, the abbreviation "CF" denotes "center front"; the abbreviation "FR" denotes "front"; the abbreviation "RT" denotes "right"; the abbreviation "Pkt" denotes a "pocket"; the abbreviation "BK" denotes the rear or back; the abbreviation "CB" denotes the center bank.

| Drawing Figure | Pattern Piece Name | Pattern Piece Approximate Measurements (in inches) | Quantity Required |
|---|---|---|---|
| A | FR Side Lining | 27 1/4 × 3 3/4 | 2 |
| B | CF Lining | 31 1/16 × 7 3/16 | 2 |
| C | FR Side Panel | 28 5/8 × 6 3/8 | 2 |
| D | CF Panel | 32 5/16 × 7 3/8 | 2 |
| E | RT Flap Extension | 12 7/8 × 3 3/8 | 2 |
| F | Left Extension | 28 × 3 3/4 | 1 |
| G | FR Top Pkt Bag | 10 1/4 × 6 7/8 | 2 |
| H | FR Under Pkt Bag | 10 1/4 × 8 3/16 | 2 |
| I | Outer Collar | 22 5/8 × 4 1/4 | 1 |
| J | Inside Collar | 22 1/2 × 3 1/16 | 1 |
| K | BK Side Panel | 28 5/16 × 8 15/16 | 2 |
| L | Shoulder | 6 3/4 × 3 1/8 | 2 |
| M | CB Panel | 35 9/16 × 17 | 1 |
| N | CB Label Mount | 6 9/16 × 9 1/4 | 1 |
| O | Side Gusset Rib Knit | 23 5/8 × 6 1/2 | 2 |
| P | Under Sleeve Lining | 23 3/8 × 6 | 2 |
| Q | Under Sleeve | 24 1/2 × 6 | 2 |
| R | Top Sleeve | 26 1/2 × 9 1/2 | 2 |
| S | Top Sleeve Lining | 25 1/2 × 9 7/16 | 2 |
| T | Sleeve Under Pkt Bag | 10 × 7 1/8 | 2 |
| U | Sleeve Upper Pkt Bag | 10 3/16 × 7 7/8 | 2 |

Figure 16:
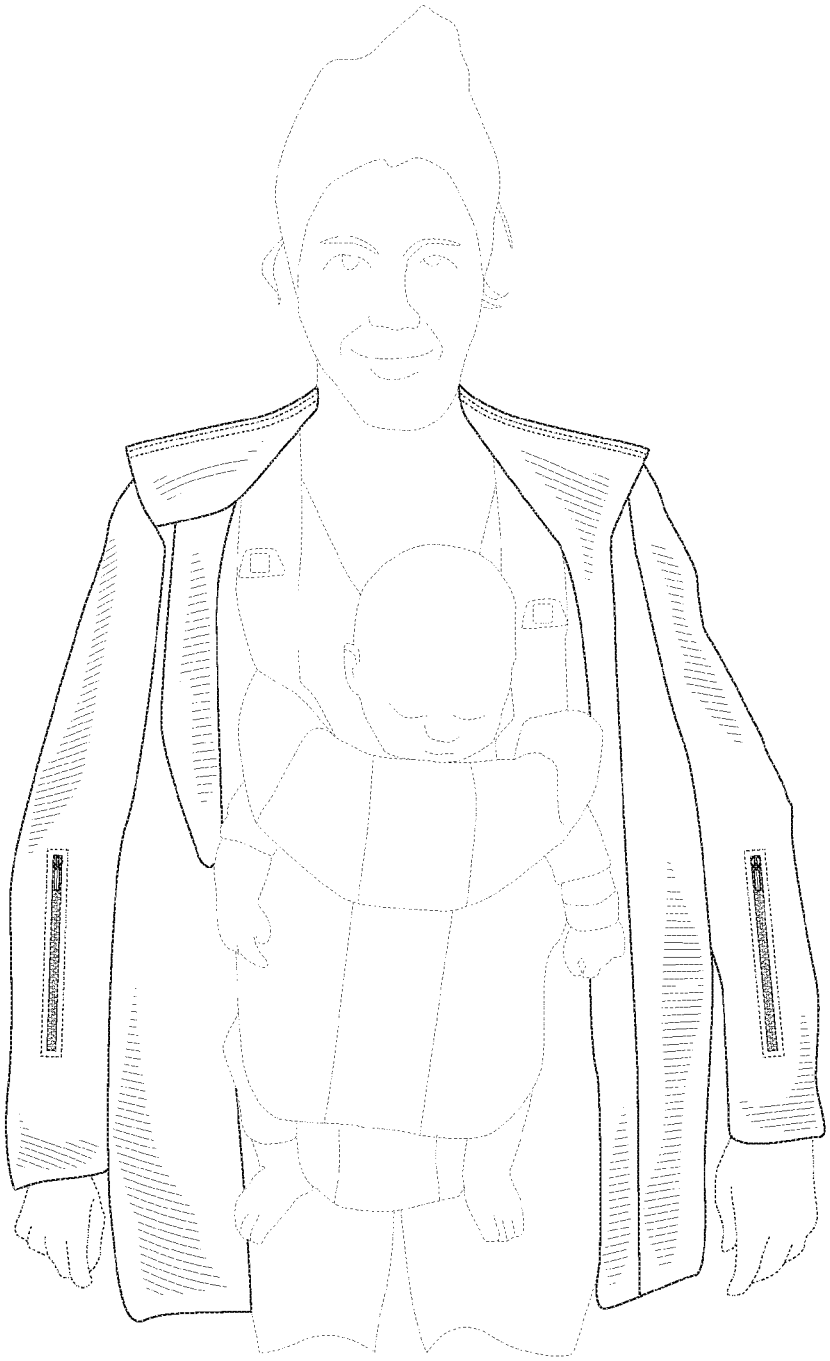
FIG. 16 is a front view of the garment illustrated in FIGS. 1 through 15 in use by an adult female carrying an infant in the garment, with the infant's head and arms visible.
Figure 17:
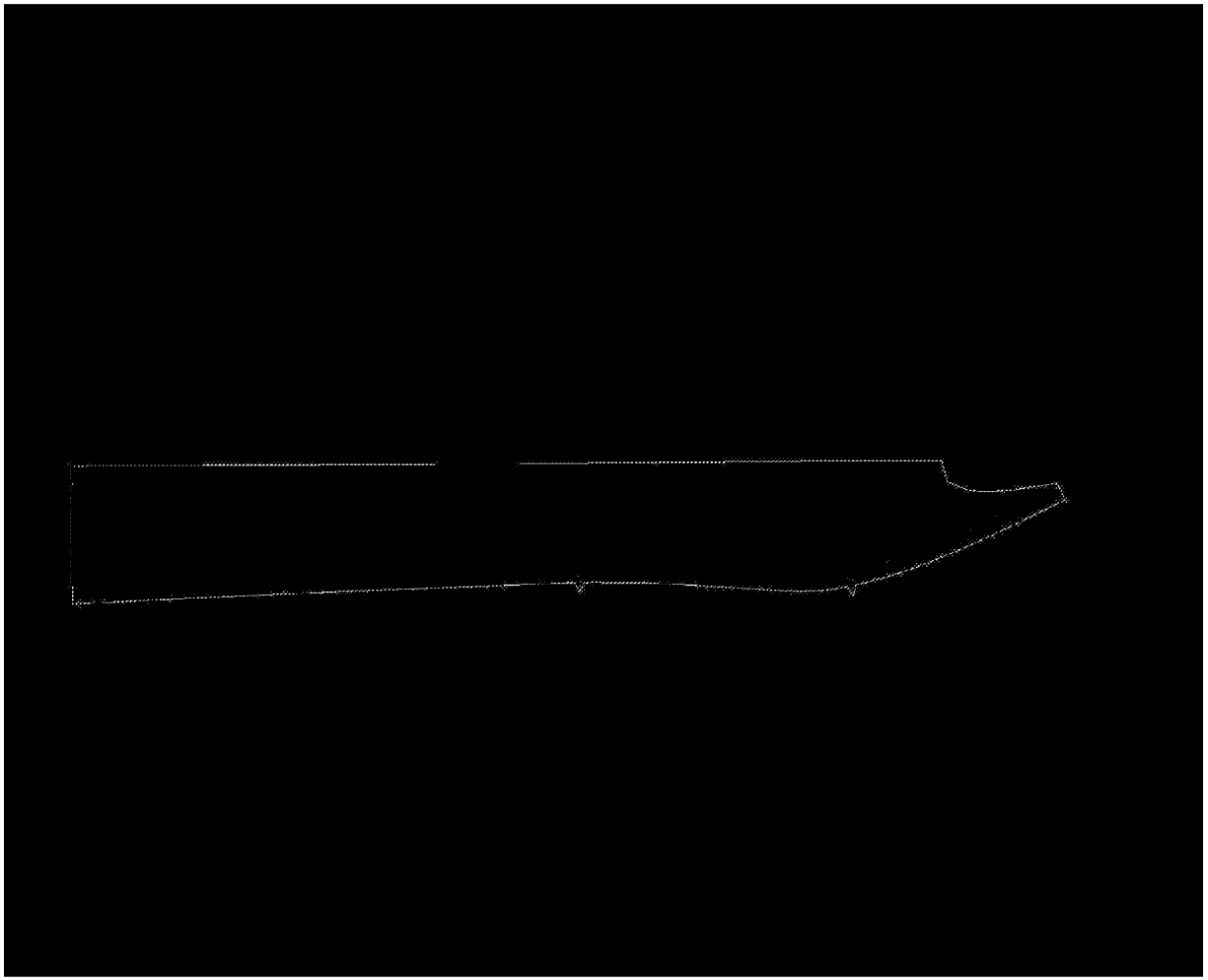
FIG. 17 is a pattern piece for the front side lining of the garment illustrated in FIGS. 1 through 16.
Figure 18:
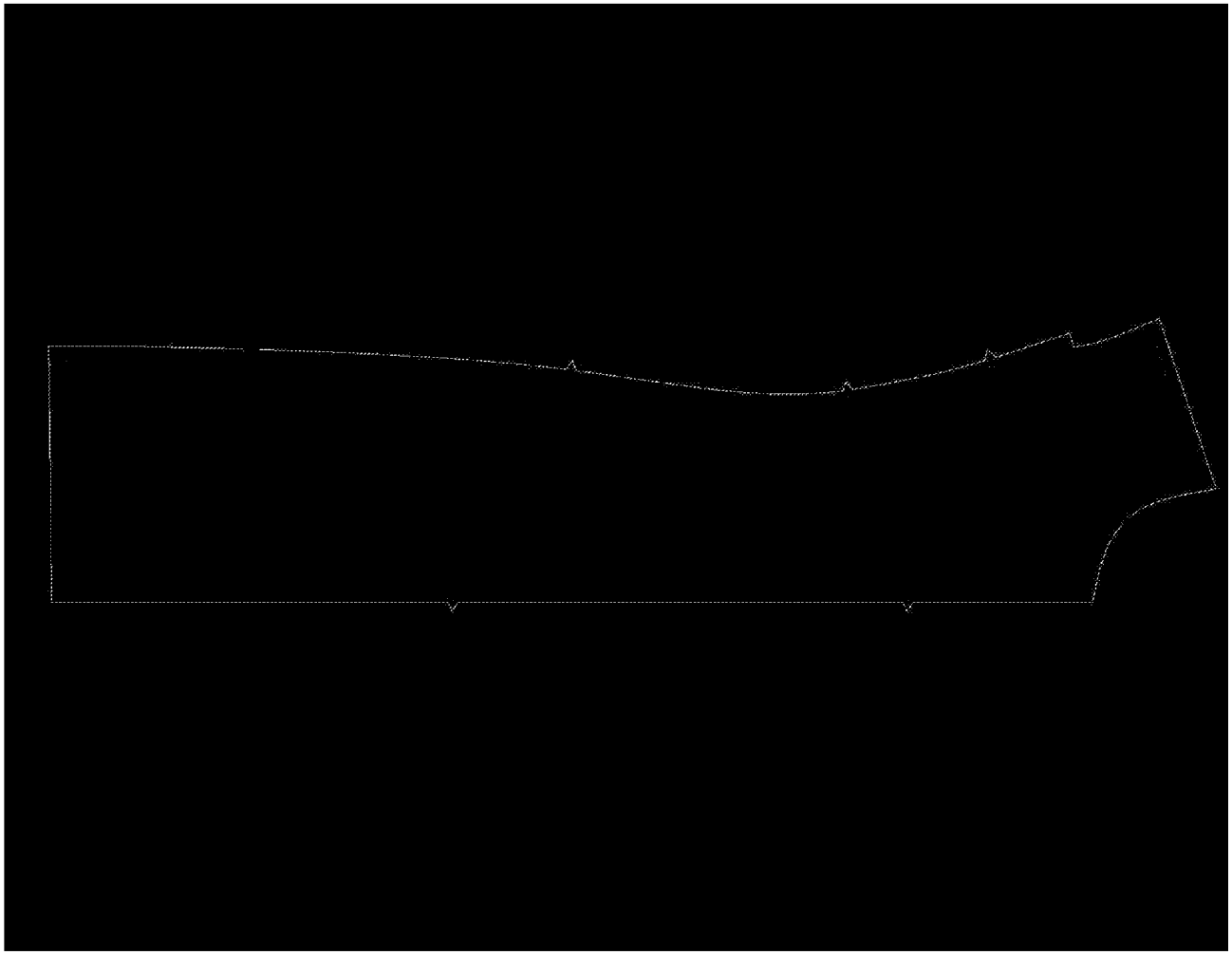
FIG. 18 is a pattern piece for the center front lining of the garment illustrated in FIGS. 1 through 16.
Figure 19:
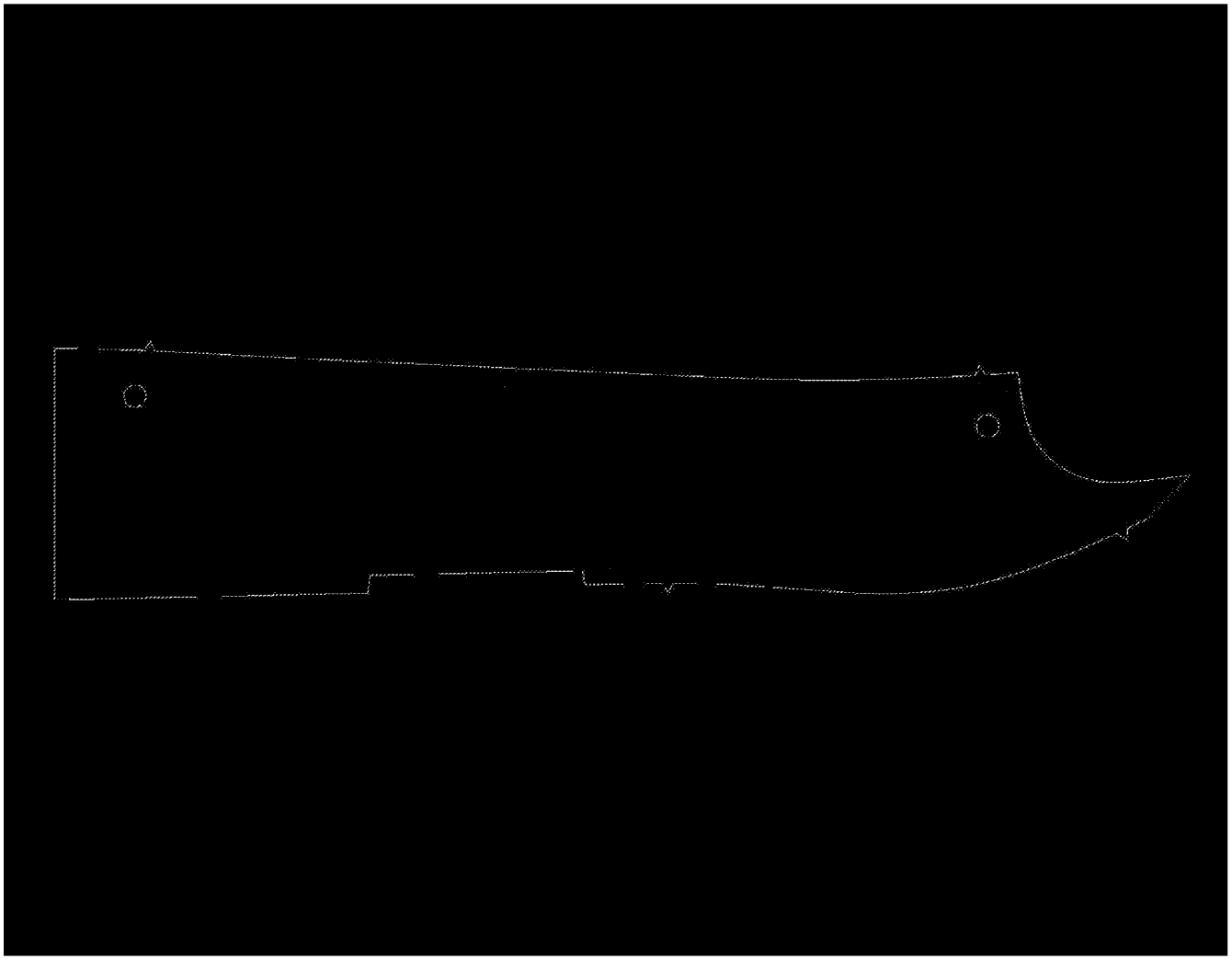
FIG. 19 is a pattern piece for the front side panel of the garment illustrated in FIGS. 1 through 16.
Figure 20:
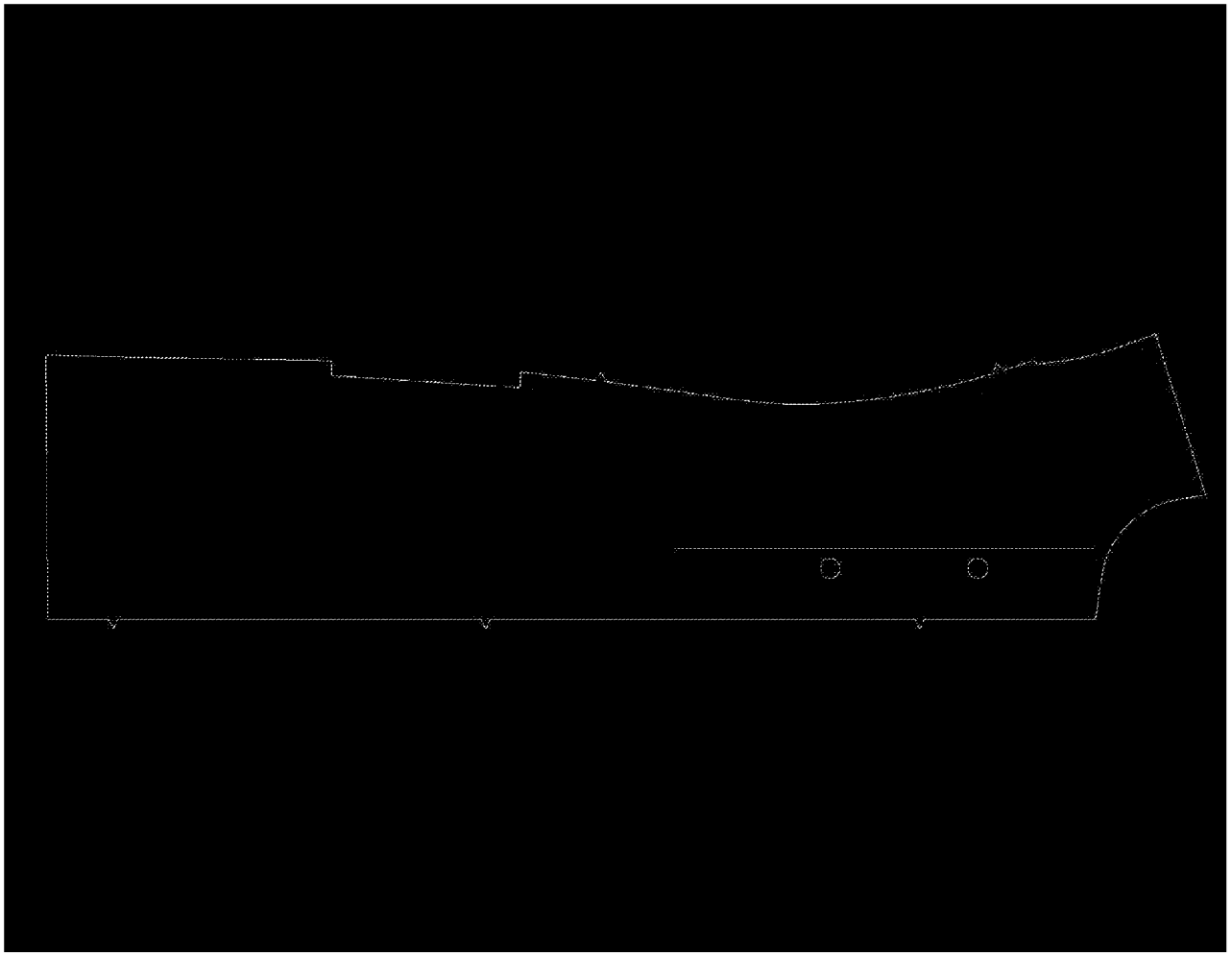
FIG. 20 is a pattern piece for the center front panel of the garment illustrated in FIGS. 1 through 16.
Figure 21:
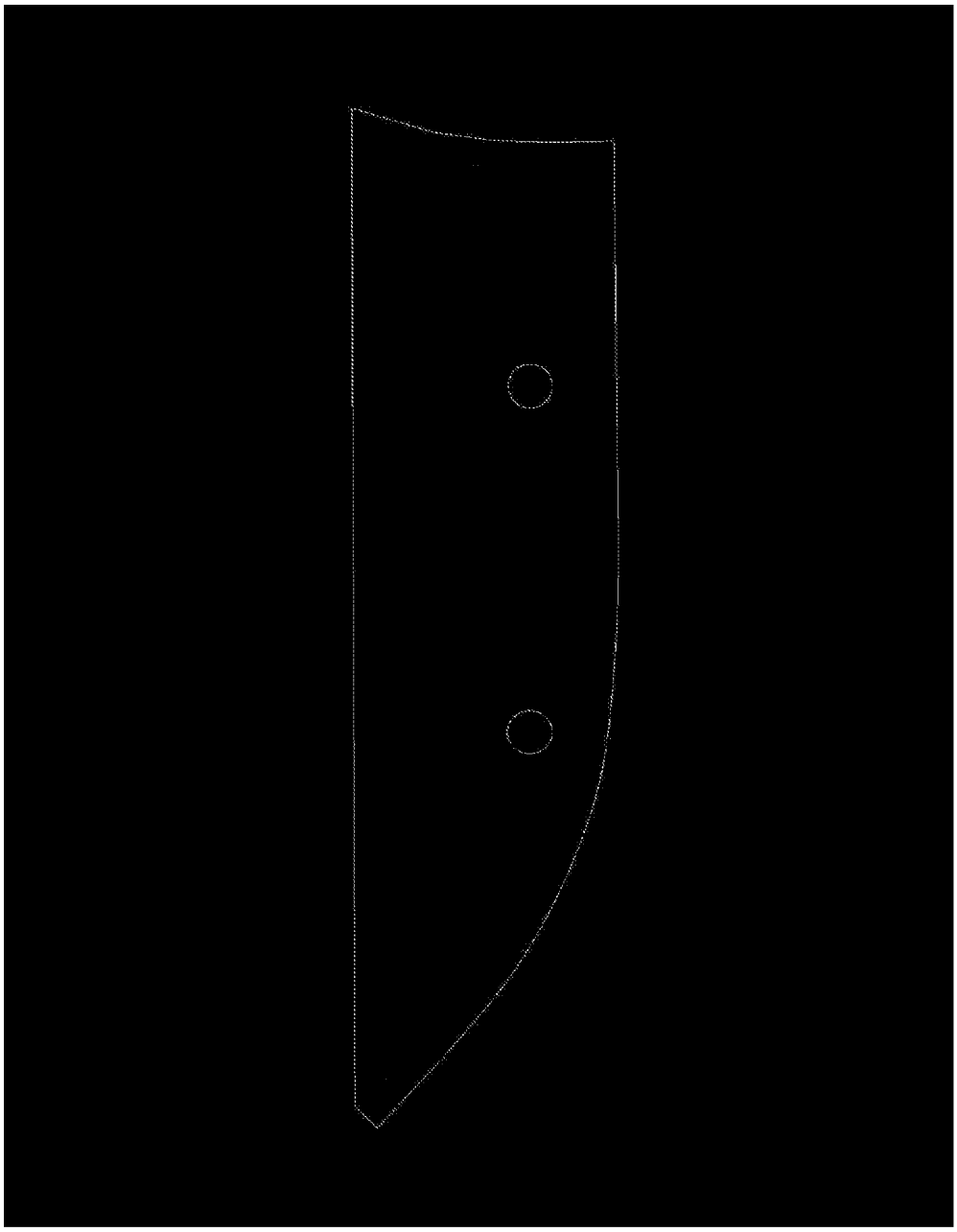
FIG. 21 is a pattern piece for the right flap extension of the garment illustrated in FIGS. 1 through 16.
Figure 22:
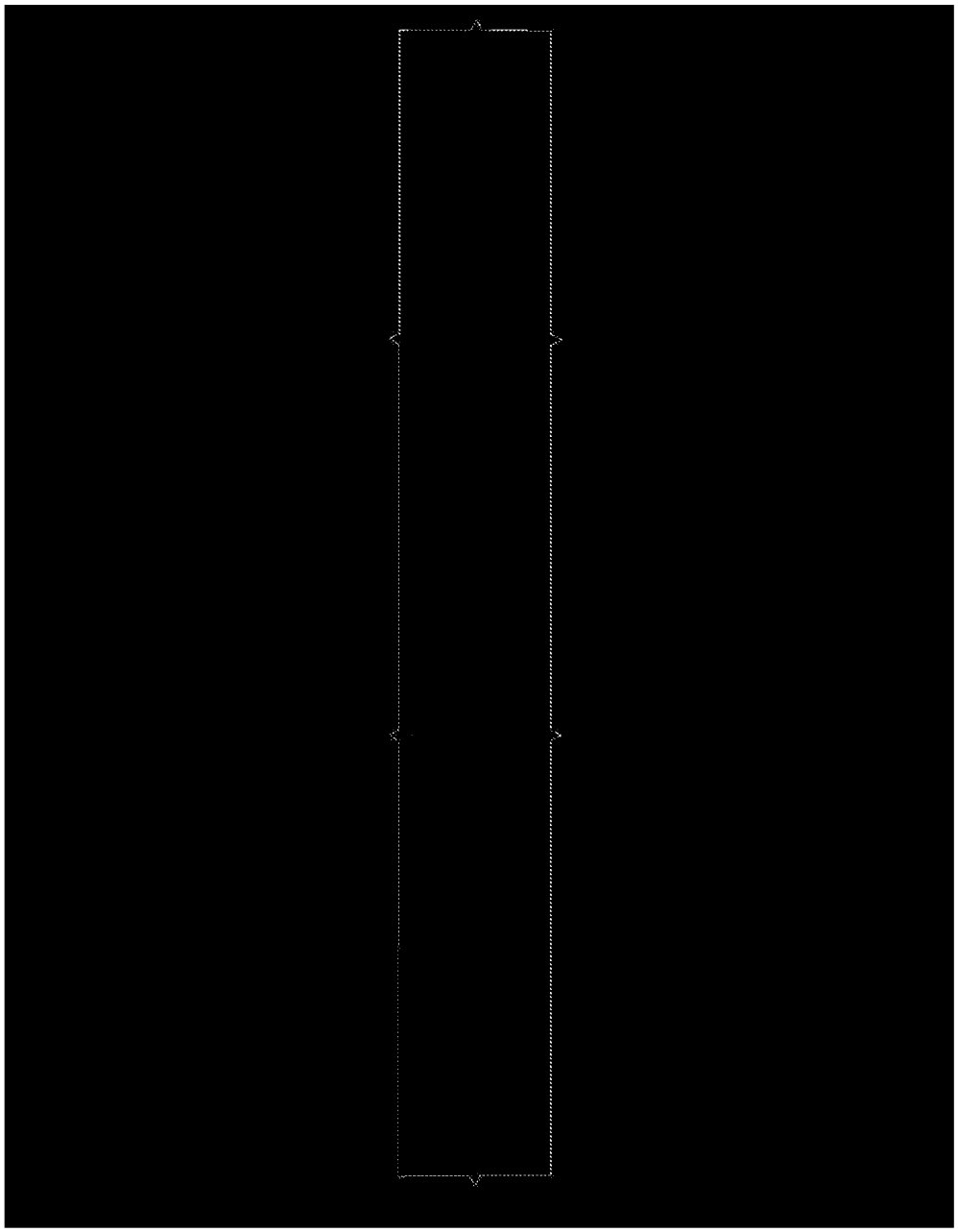
FIG. 22 is a pattern piece for the left extension of the garment illustrated in FIGS. 1 through 16.
Figure 23:
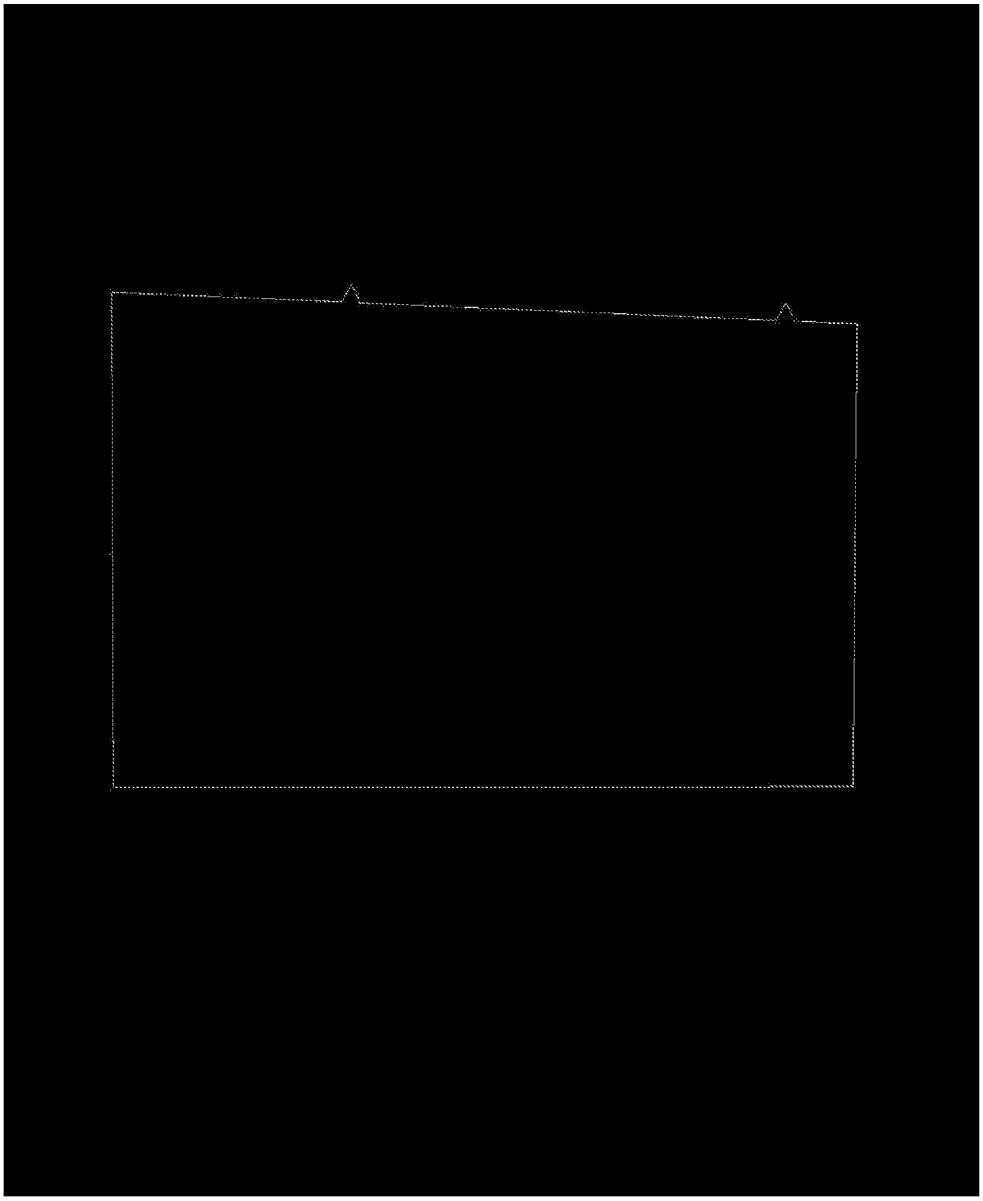
FIG. 23 is a pattern piece for the front top pocket bag of the garment illustrated in FIGS. 1 through 16.
Figure 24:
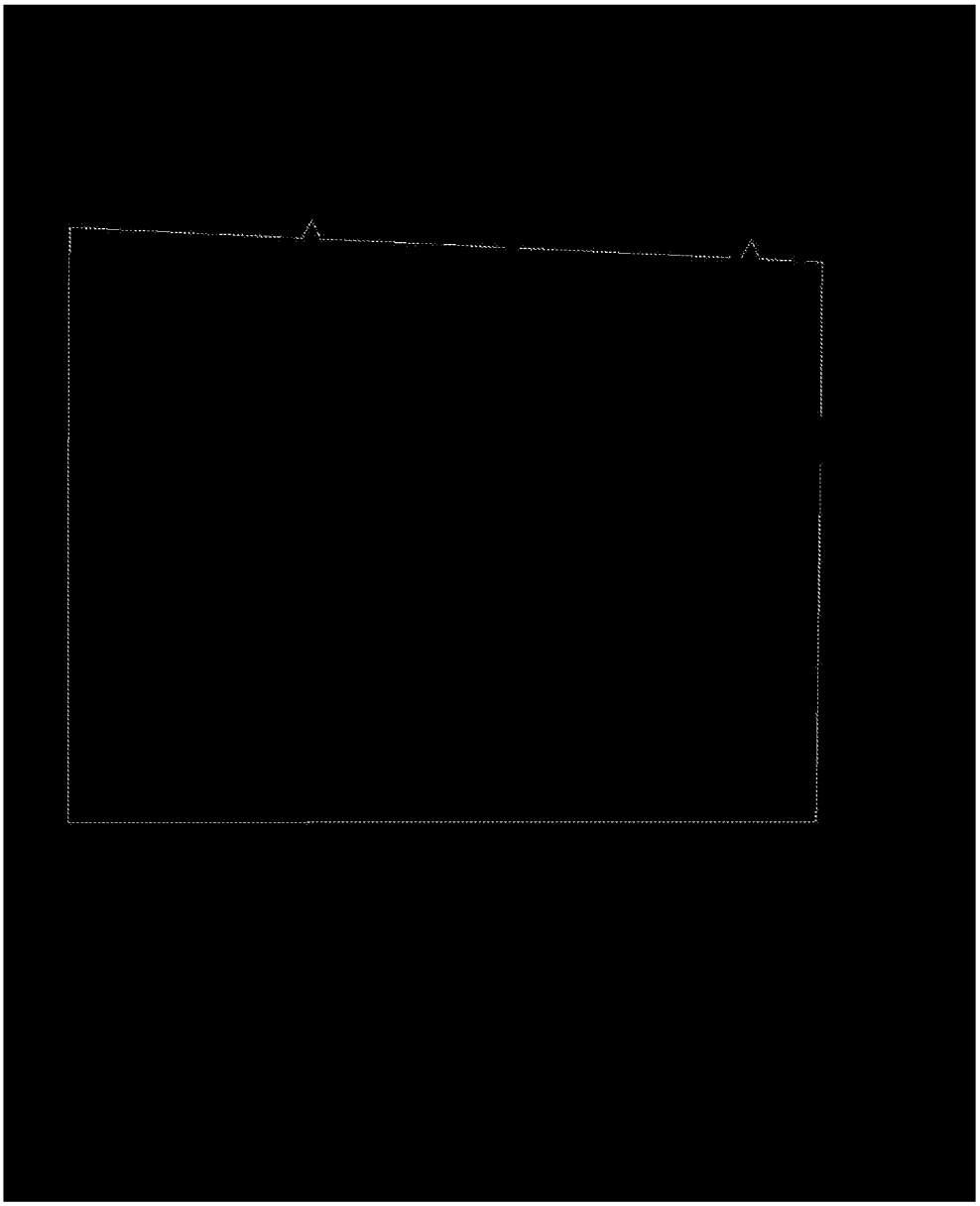
FIG. 24 is a pattern piece for the front under pocket bag of the garment illustrated in FIGS. 1 through 16.
Figure 25:
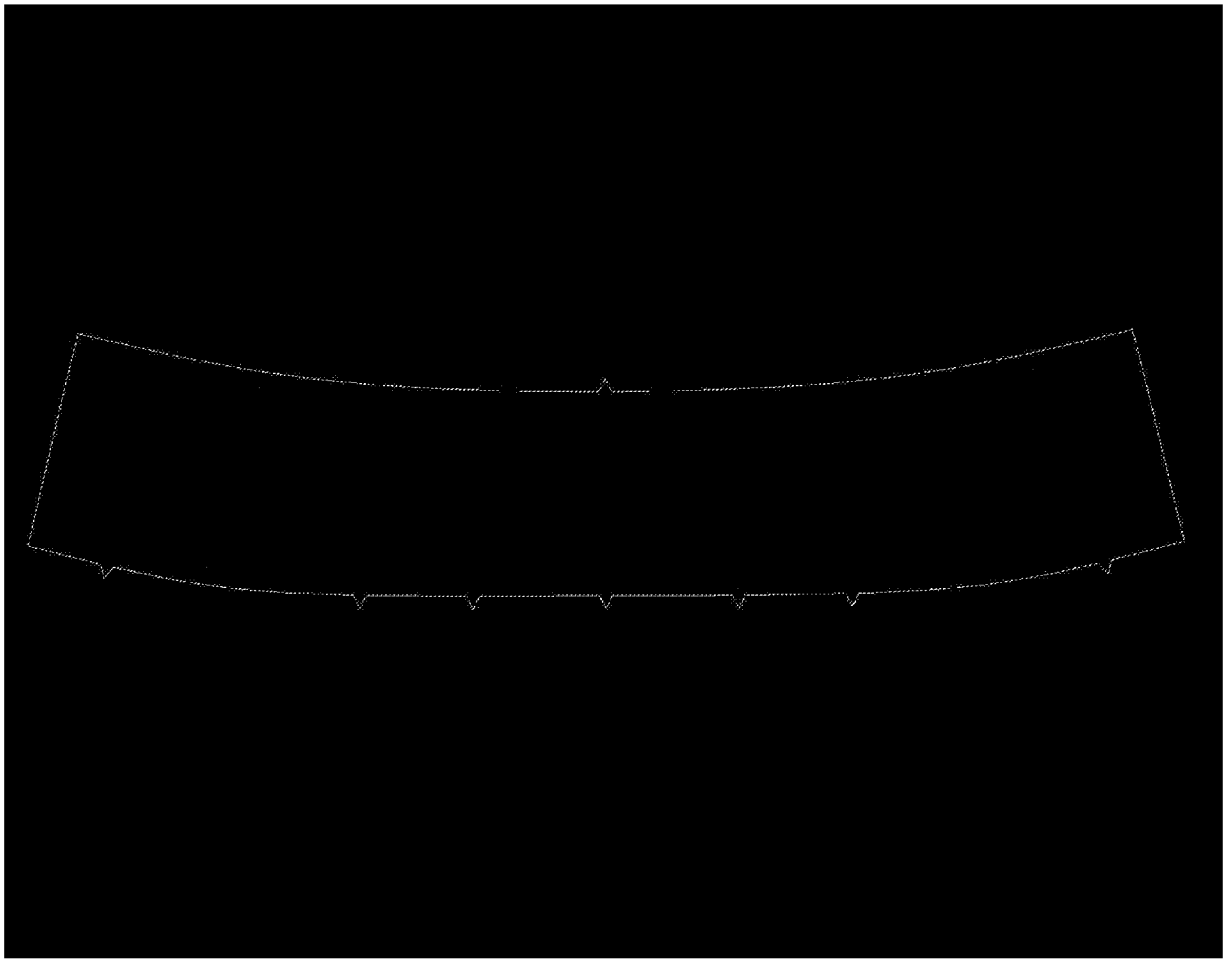
FIG. 25 is a pattern piece for the outer collar of the garment illustrated in FIGS. 1 through 16.
Figure 26:
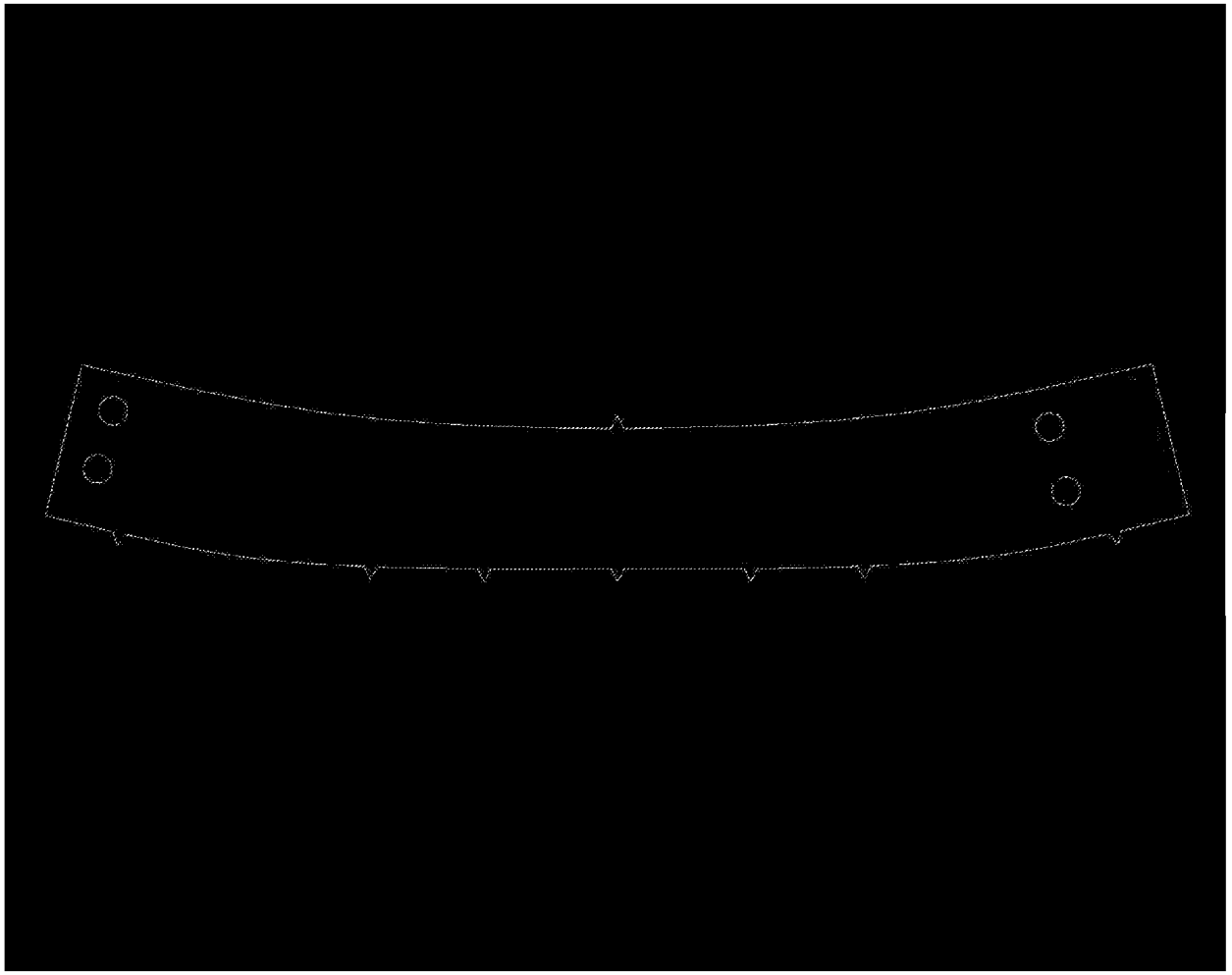
FIG. 26 is a pattern piece for the inside collar of the garment illustrated in FIGS. 1 through 16.
Figure 27:
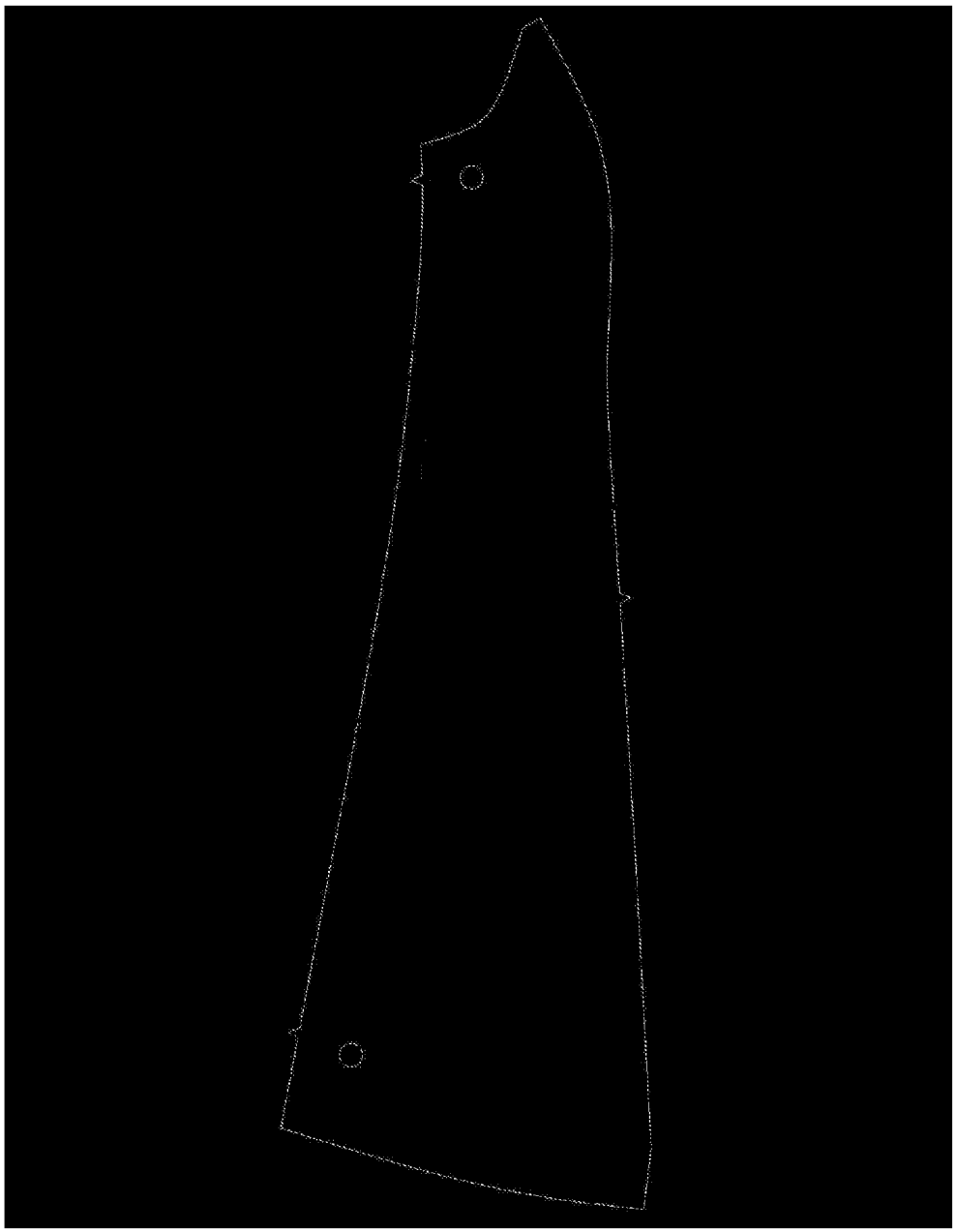
FIG. 27 is a pattern piece for the back side panel of the garment illustrated in FIGS. 1 through 16.
Figure 28:
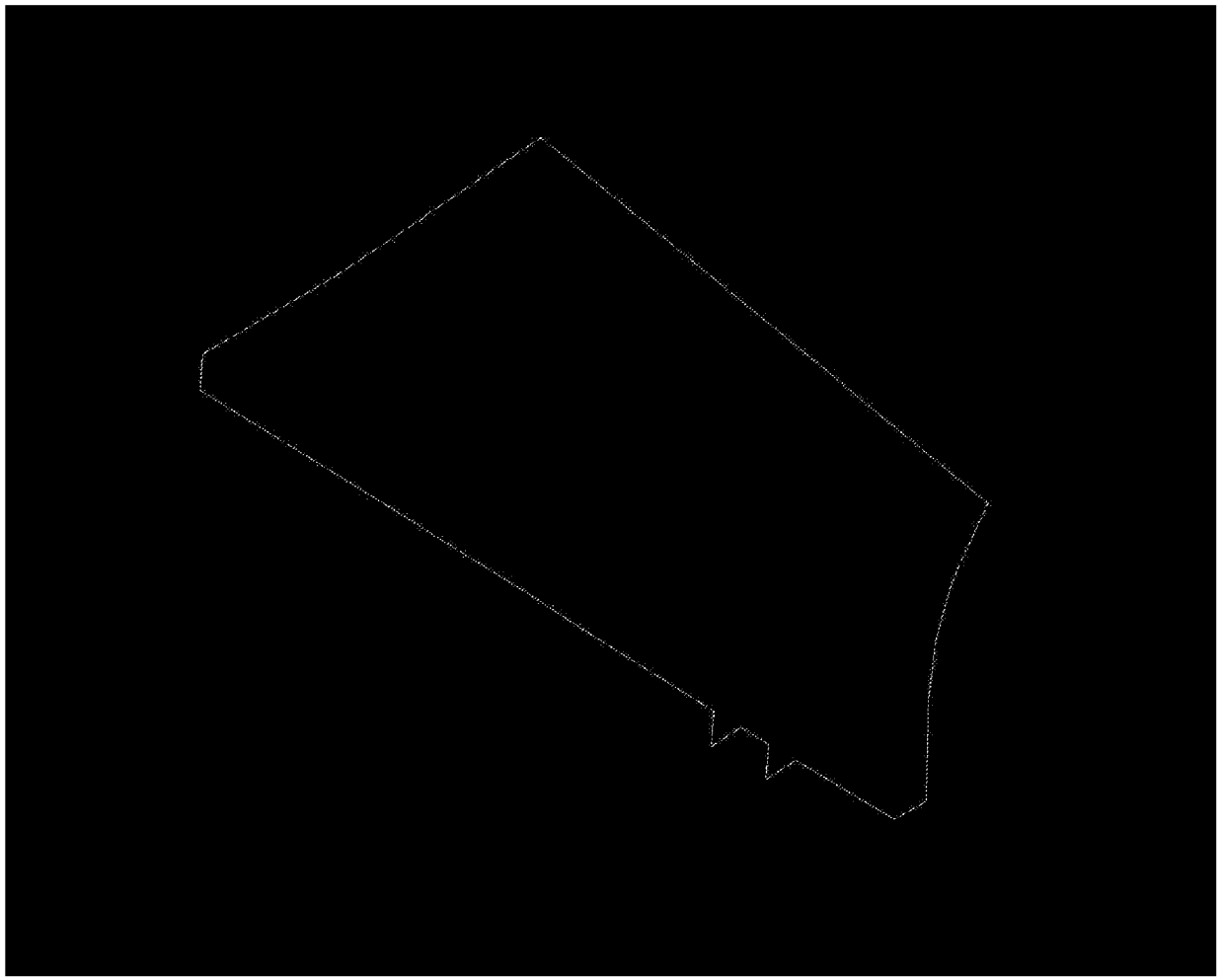
FIG. 28 is a pattern piece for the shoulder of the garment illustrated in FIGS. 1 through 16.
Figure 29:
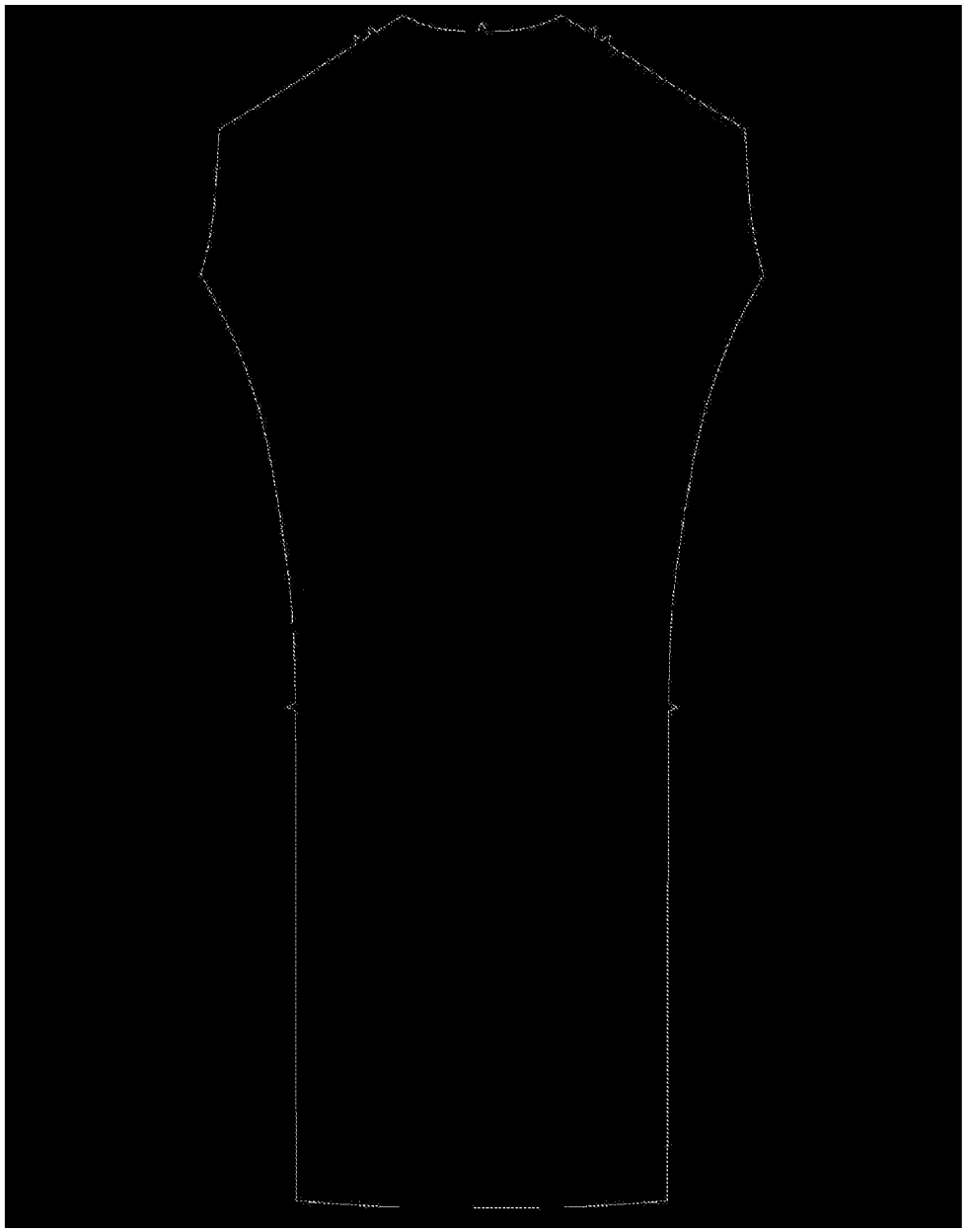
FIG. 29 is a pattern piece for the center back panel of the garment illustrated in FIGS. 1 through 16.
Figure 30:
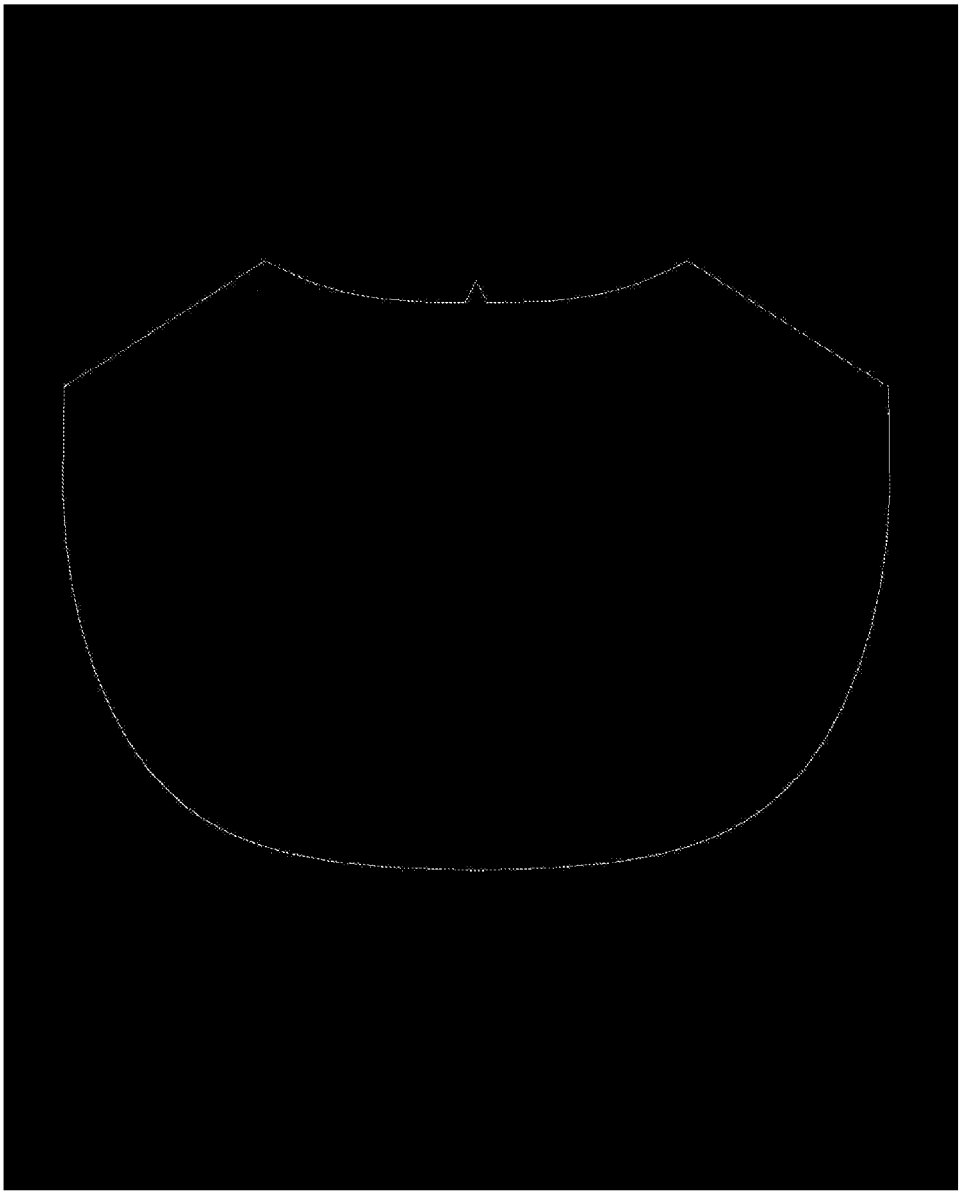
FIG. 30 is a pattern piece for the center back label mount of the garment illustrated in FIGS. 1 through 16.
Figure 31:
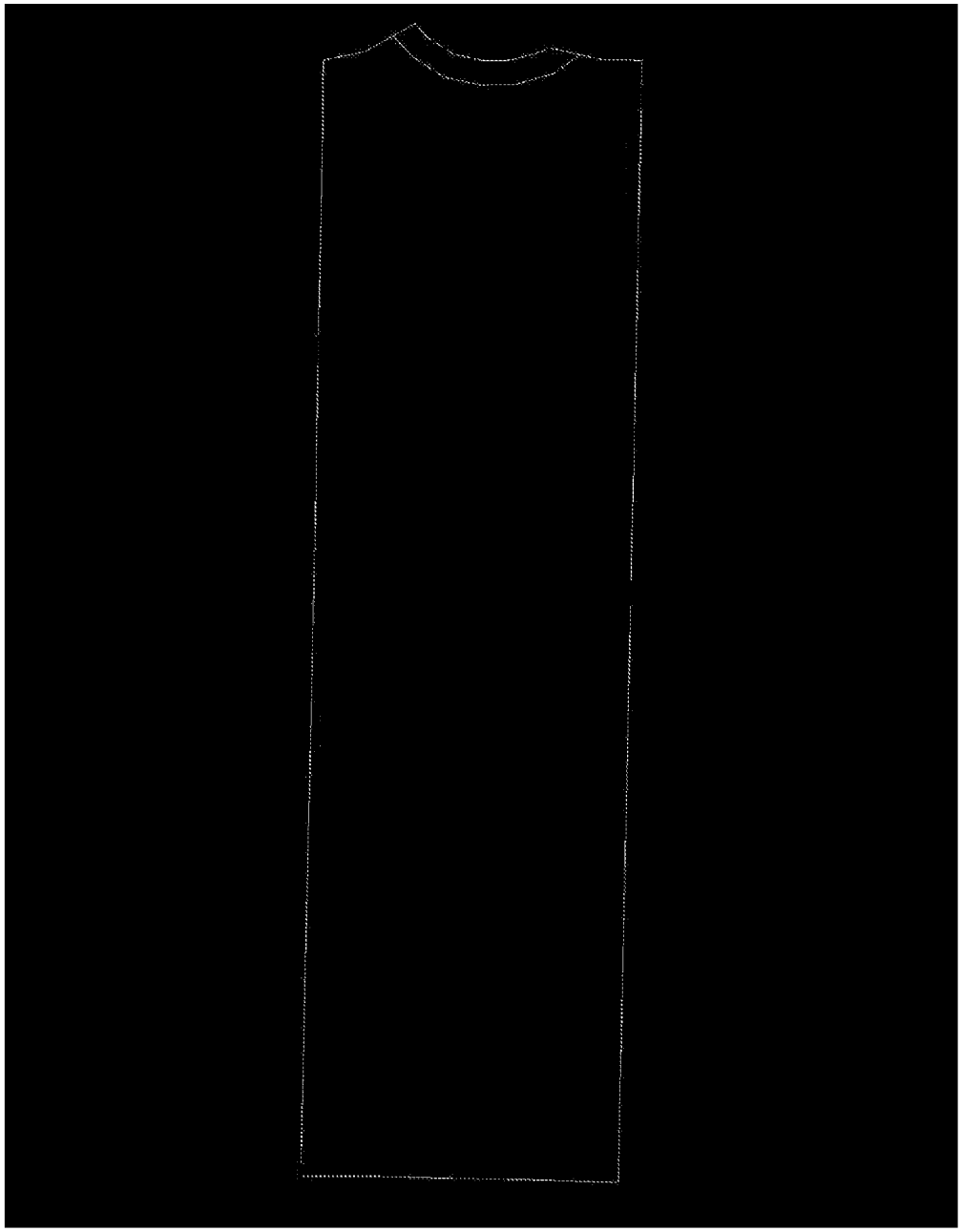
FIG. 31 is a pattern piece for the rib knit side gusset of the garment illustrated in FIGS. 1 through 16.
Figure 32:
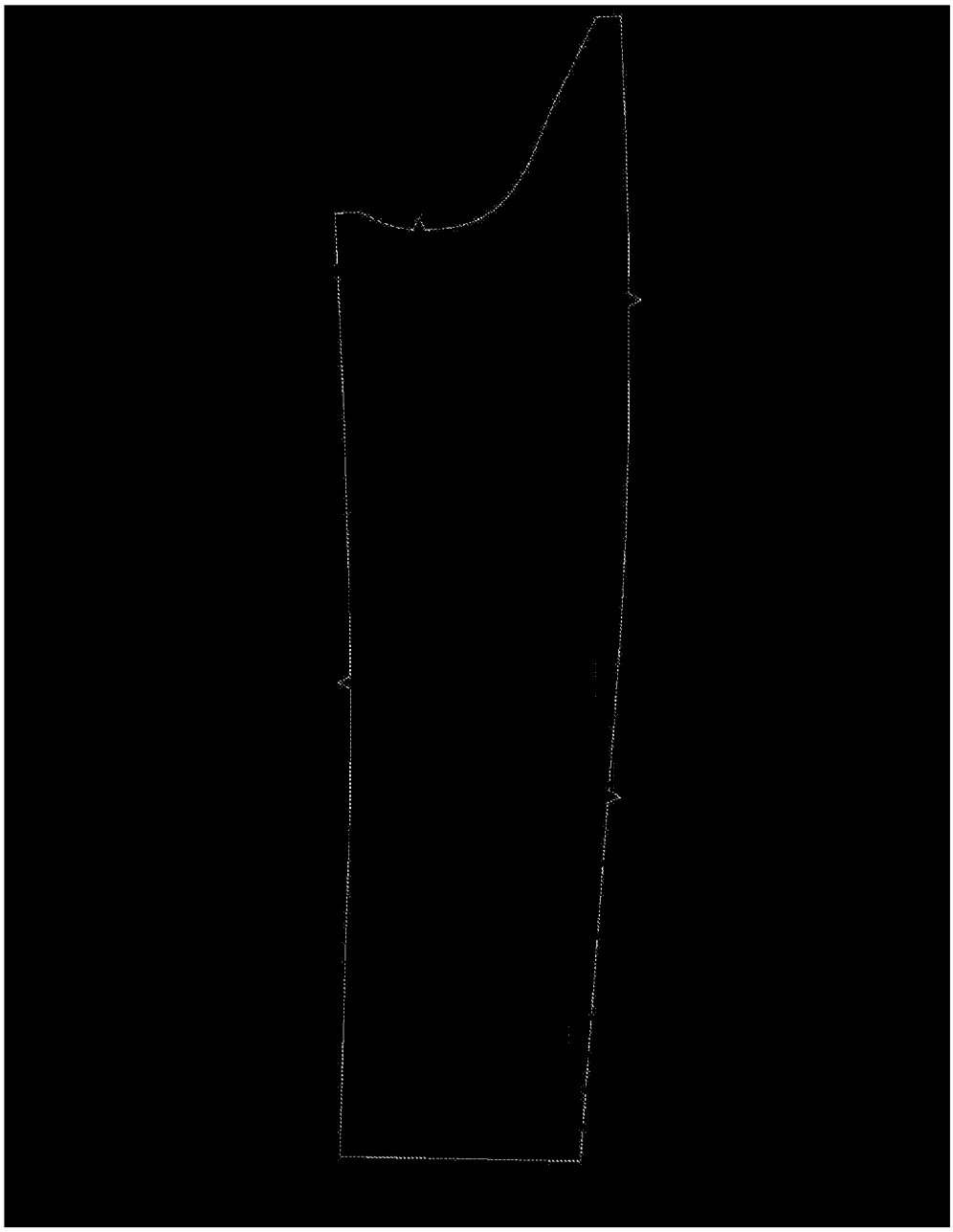
FIG. 32 is a pattern piece for the under sleeve lining of the garment illustrated in FIGS. 1 through 16.
Figure 33:
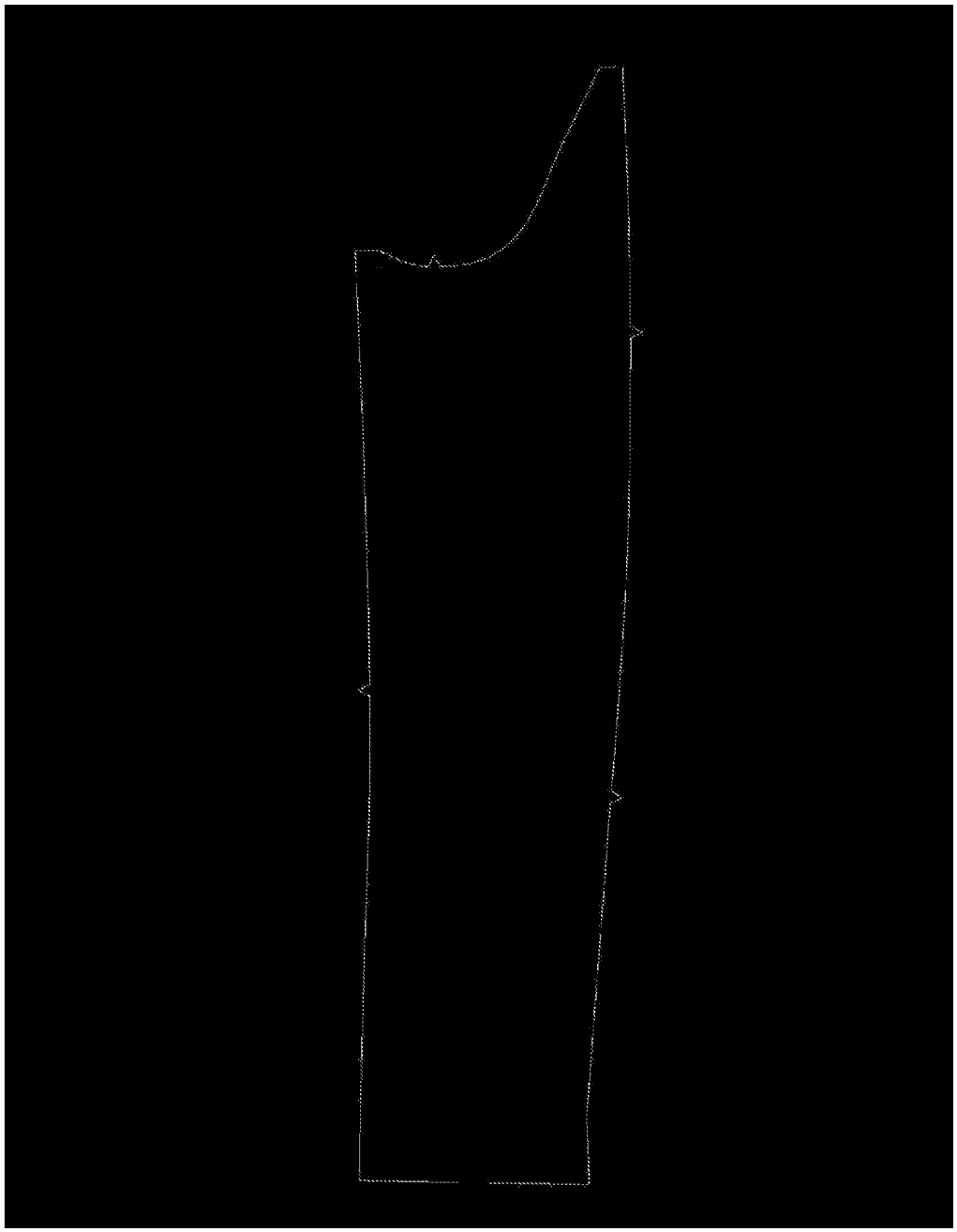
FIG. 33 is a pattern piece for the under sleeve of the garment illustrated in FIGS. 1 through 16.
Figure 34:
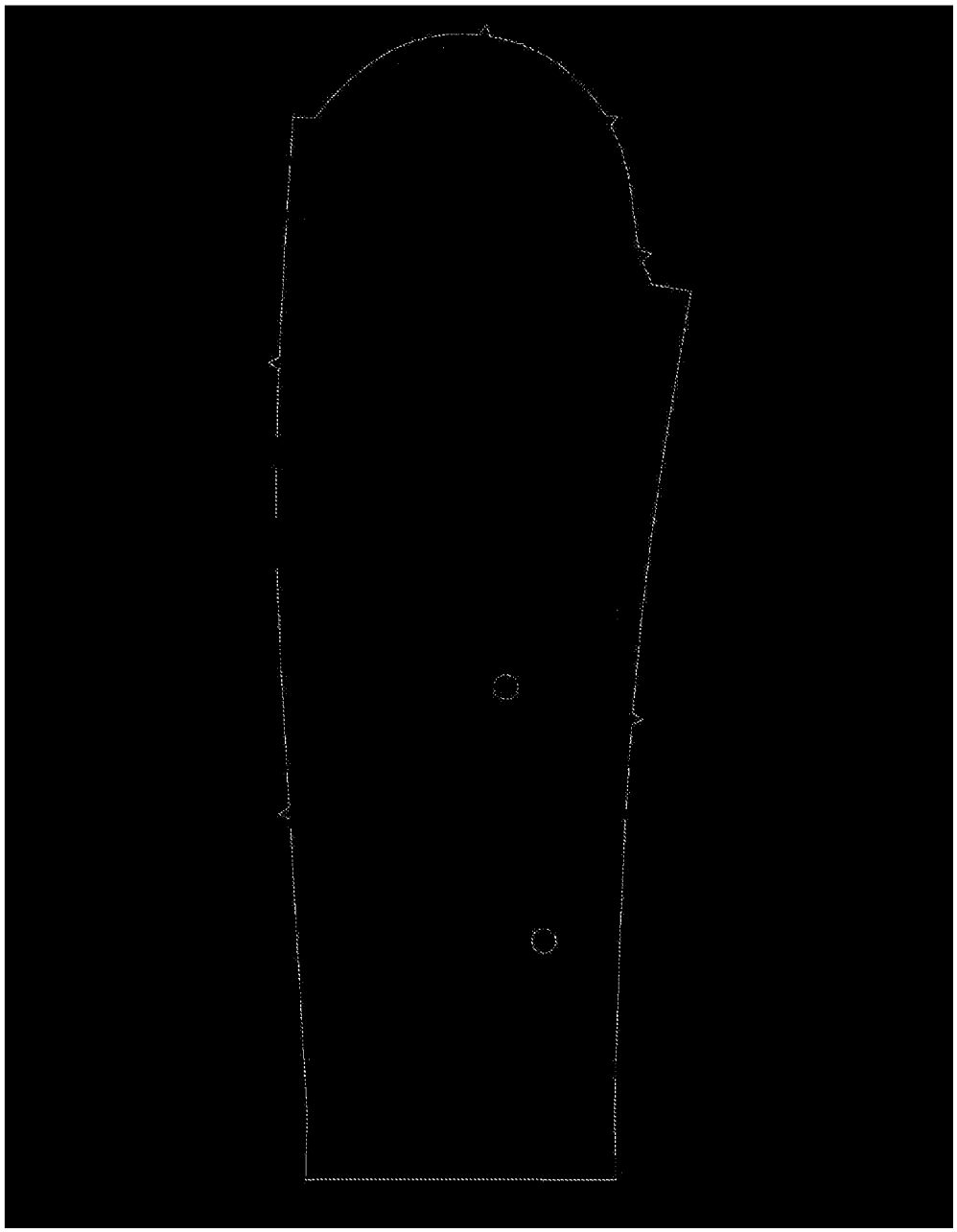
FIG. 34 is a pattern piece for the top sleeve of the garment illustrated in FIGS. 1 through 16.
Figure 35:
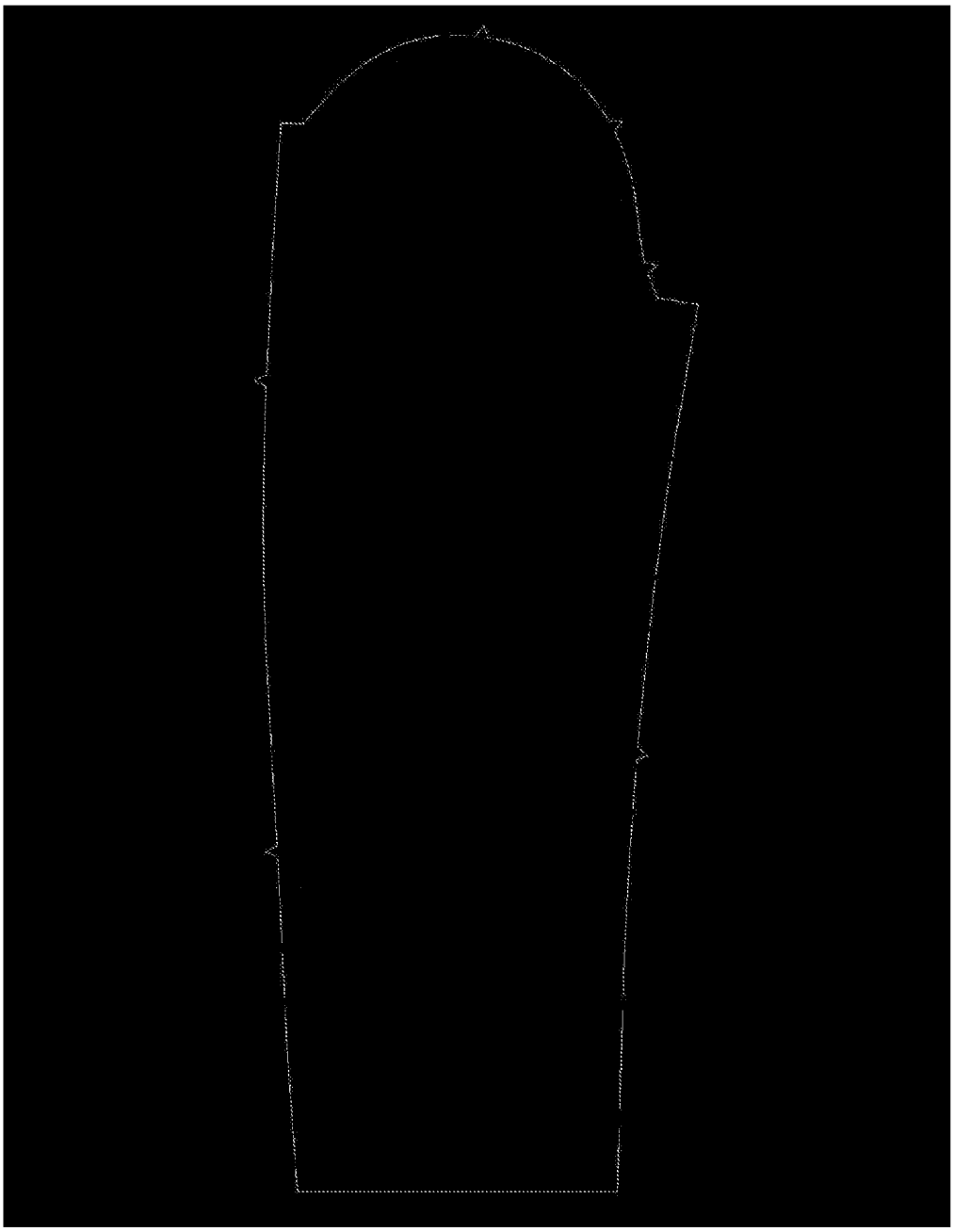
FIG. 35 is a pattern piece for the top sleeve lining of the garment illustrated in FIGS. 1 through 16.
Figure 36:
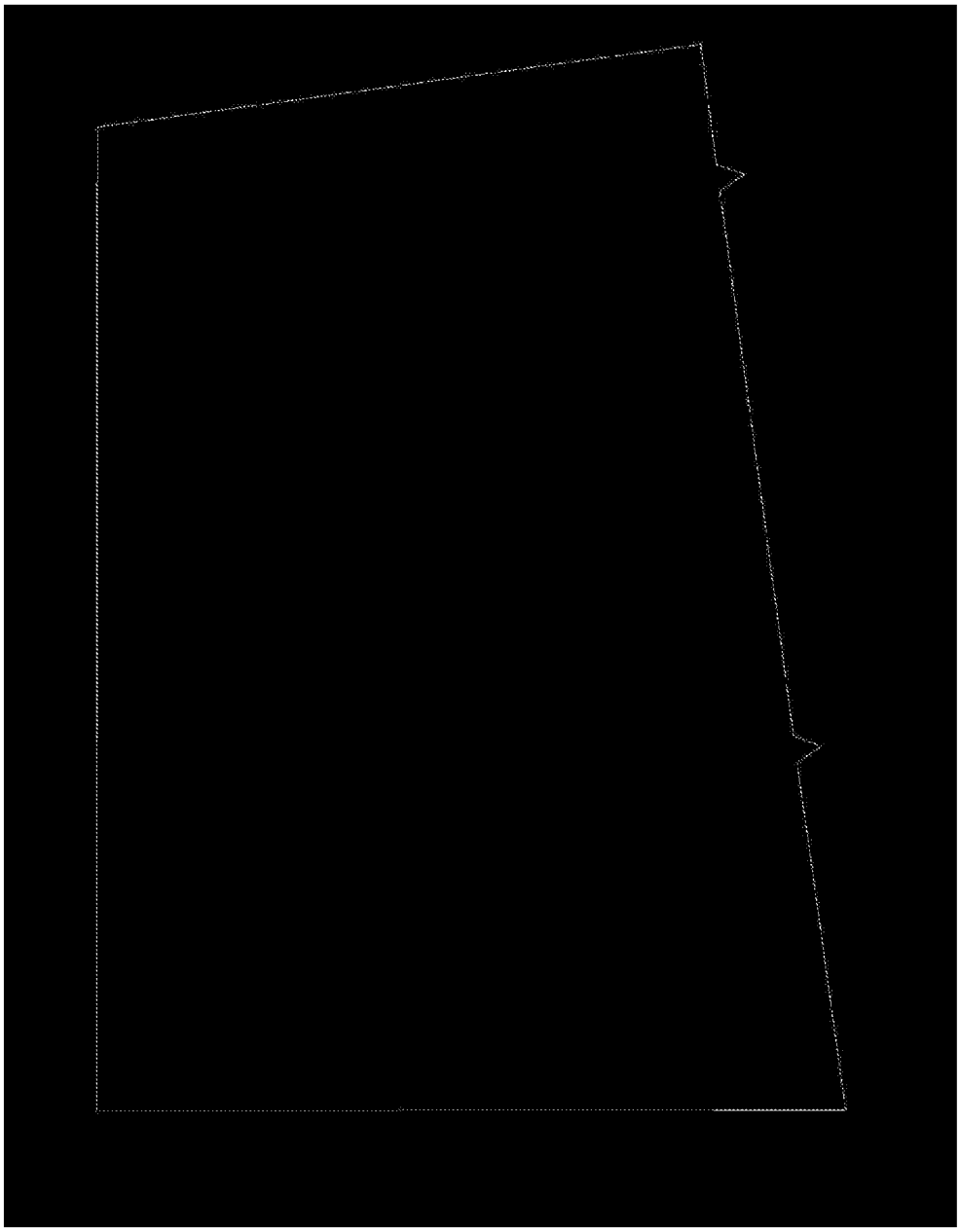
FIG. 36 is a pattern piece for the Sleeve Under pocket Bag of the garment illustrated in FIGS. 1 through 16.
Figure 37:
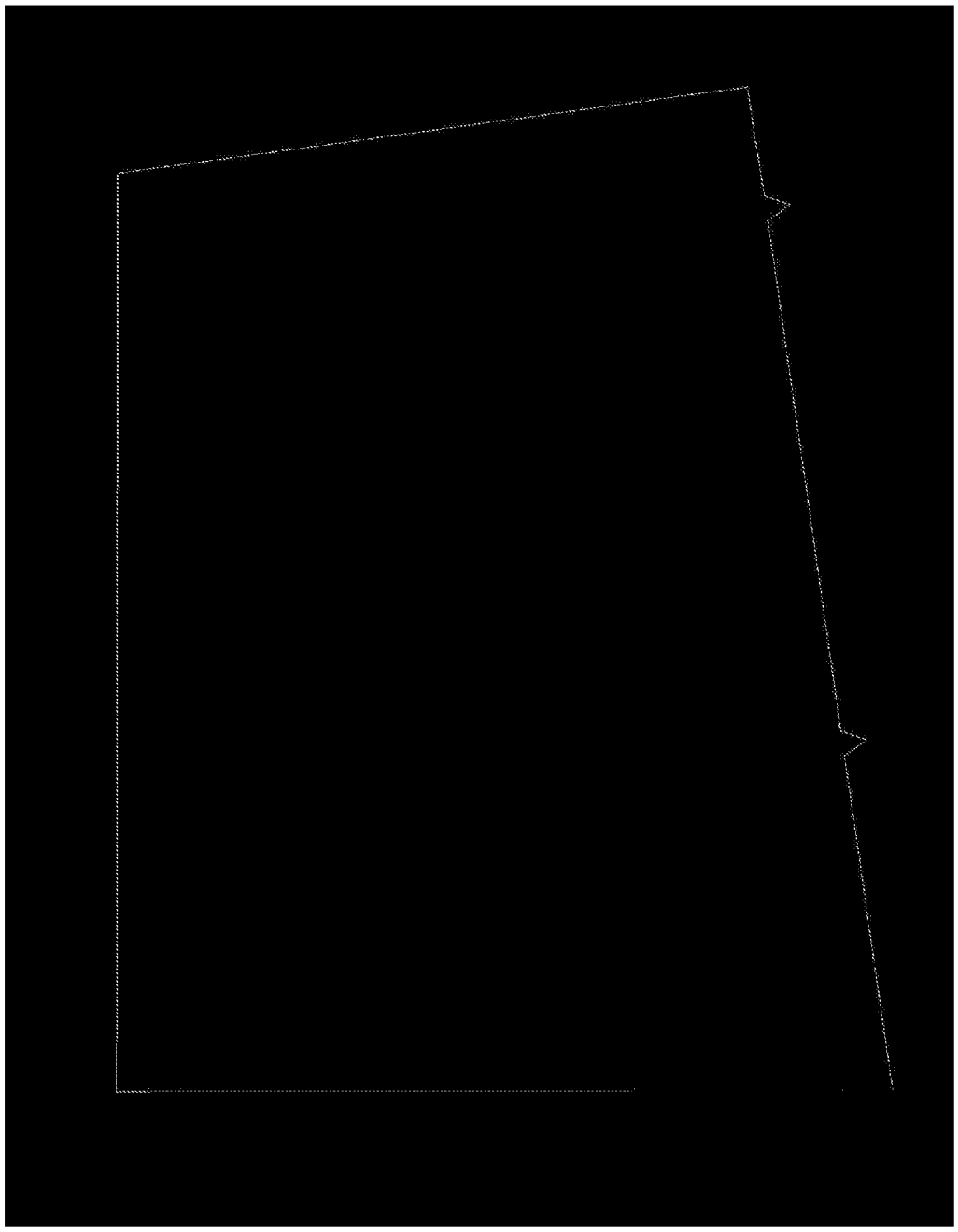
FIG. 37 is a pattern piece for the Sleeve Upper pocket Bag of the garment illustrated in FIGS. 1 through 16.

In the garment of the invention, as illustrated, left front and right front panel upper zippers 32, 62 respectively define passageways to the garment interior. These zippers 32, 62 reside in seams joining vertically extending edges of respective left and right exterior panel edges to edges of the left and right side exterior panels. These upper zippers 32, 62 are spaced from and located above lower zippers 28, 58. Zippers 32, 62, when open, allow passage into the garment interior or, passage outwardly from the garment interior, for example by the arms of an infant carried by an adult wearing the garment and carrying the infant on the adult's chest, such as is illustrated in FIG. 16, clearly showing an infant carried by an adult wearer of the garment, with the infant's arms protruding through the spaces when upper zippers 32, 62 are disengaged.

Another feature of the garment of the invention is the presence of left and right side panel bisecting zippers 150, 152 respectively as illustrated in FIGS. 12 and 13. These bisecting zippers, when closed, define the garment as being of one size. When the zippers are open, the garment is of a larger size, being expandable to accommodate persons of larger girth, or to accommodate an adult carrying an infant, for example. Left and right side panel bisecting zippers 150, 152 are located in respective left and right side exterior panels 20, 50, as well illustrated in FIGS. 12 and 13. Left and right side panel bisecting zippers 150, 152 preferably extend generally vertically as illustrated in FIGS. 12 and 13. Located behind left side and right side panel bisecting zippers 150, 152 are preferably fabric panels denoted 154, 156 respectively, which serve as expansion panels for the garment.

It is desirable that expansion panels 154, 156 be fabric. It is especially desirable that the fabric expansion panels 154, 156 be elastic and be elastically stretchable.

Left sleeve zipper 49 and right sleeve zipper 69 are positioned respectively in the forward portions of left and right sleeves 48, 68, and are oriented essentially vertically when the garment is worn, as illustrated in FIG. 1. Left sleeve zipper 49 and right sleeve zipper 69 define entrances to pockets formed in the respective left and right sleeves 48, 68. Vertical length of left sleeve zipper 49 and right sleeve zipper 69 are substantially the same as left front panel lower zipper 28 and right front panel lower zipper 58. However, left sleeve zipper 49 and right sleeve zipper 69 are not disposed in seams. Left front panel lower zipper 28 and right front panel lower zipper 58 defining portions of seams 208 and 210 which respectively join left and right front exterior panels 26, 56 to left side exterior panel 20 and right side exterior panel 50 are disposed in seams, as illustrated clearly in FIG. 1.

Front snaps 38 are positioned to provide overlapping closure of the upper portions of left front exterior panel 26 and right front exterior panel 56, with an upper portion of left front exterior panel 26 being formed as a placket designed to receive in overlapping fashion a corresponding interiorly facing placket formed in the upper portion along the vertically extending edge of right front exterior panel 56. Overlapping of the placket portions provides secure warmth when snaps portions 38M and 38F are engaged, and the plackets are in overlapping facing contact one with another.

Waist drawstring 40 is equipped with a pair of spring-loaded drawstring push button releasable fasteners 46, which the user may use to draw and hold waist drawstring 40 more tightly around the wearer's waist or loins, thereby to prevent loss of body heat.

In the drawing figures showing the patterns for fabricating the garment of the invention, notches are shown for matching edges of adjoining pattern pieces as a seamstress sews the garment of the invention.

Figure 6:
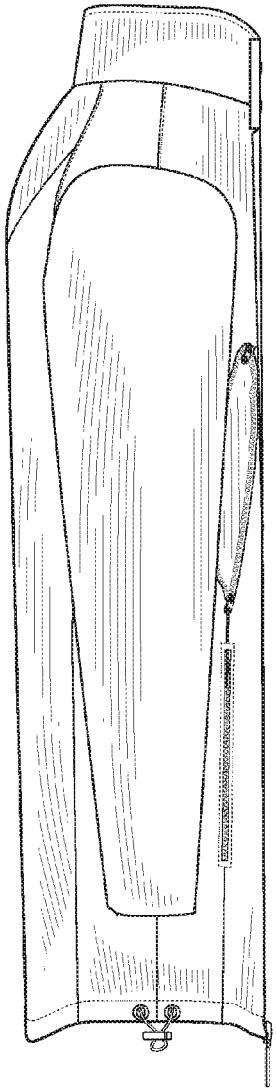
FIG. 6 is a right side elevation of the garment illustrated in FIGS. 1 through 5 with the right front panel upper zipper open, exposing a left side interior portion of the garment.

When viewing FIG. 6, item 66 denotes the lining on the left side of the garment, which is seen looking through the opening defined when zipper 62 is in the open, disengaged position. It is to be understood that the opening defined by zipper 62 in its position as right front panel upper zipper, provides an opening to the interior of the jacket. Hence, in the view provided in FIG. 6, item 66 is actually the left inside lining of the jacket as one would look from the right side looking into and through the interior of the jacket and seeing the left inside lining. As noted above, the opening defined by disengagement of the zipper 62 is particularly suited for the arms of an infant or small child carried by the wearer of the garment, as shown in FIG. 16.

Figure 7:
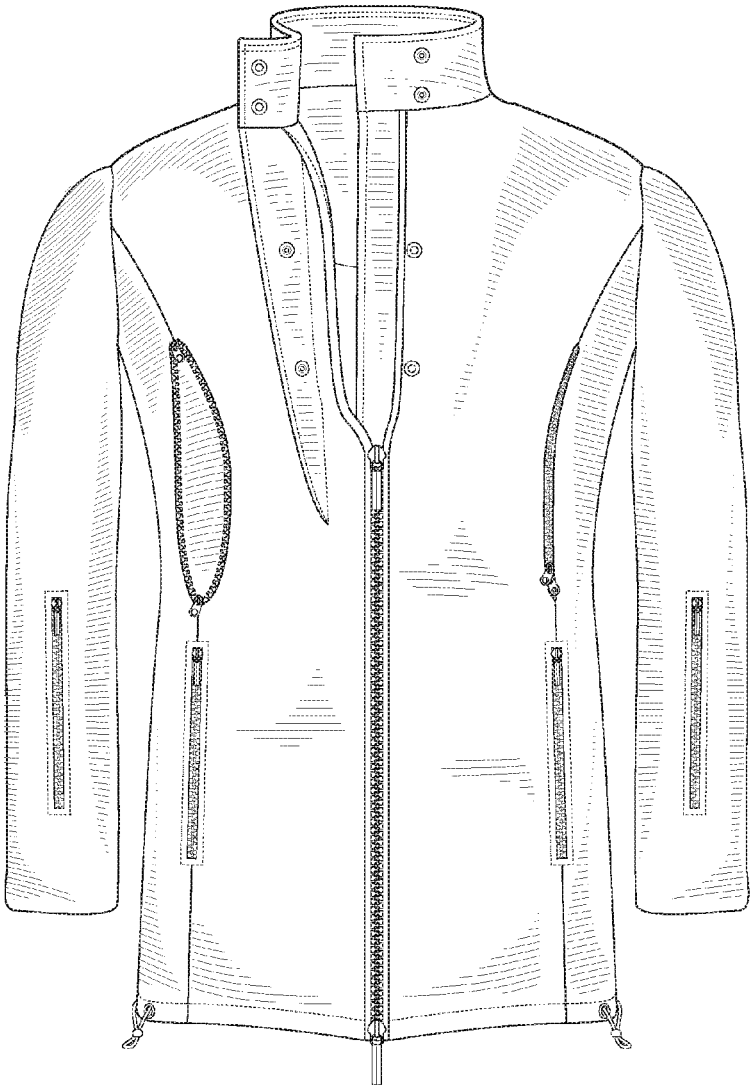
FIG. 7 is a front elevation of the garment illustrated in FIGS. 1 through 6 with the right front panel upper zipper open, exposing a right rear interior portion of the garment.
Figure 8:
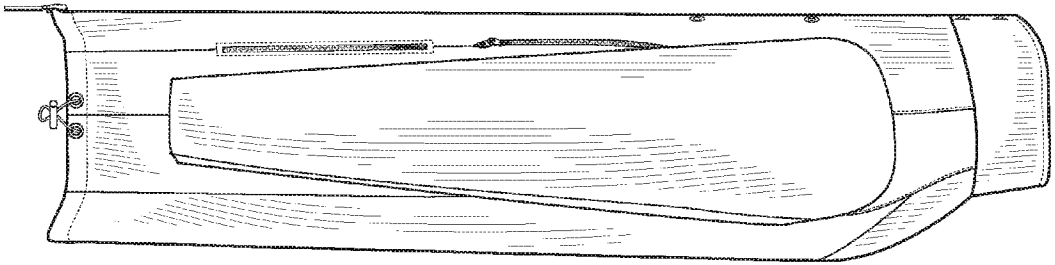
FIG. 8 is a left side elevation of the garment illustrated in FIGS. 1 through 7 with the left front panel upper and lower zippers closed.
Figure 9:
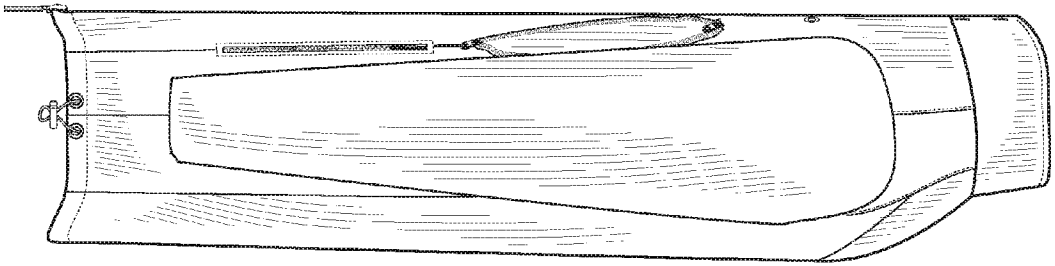
FIG. 9 is a left side elevation of the garment illustrated in FIGS. 1 through 8 with the left front panel upper zipper open, exposing a right side interior portion of the garment.
Figure 10:
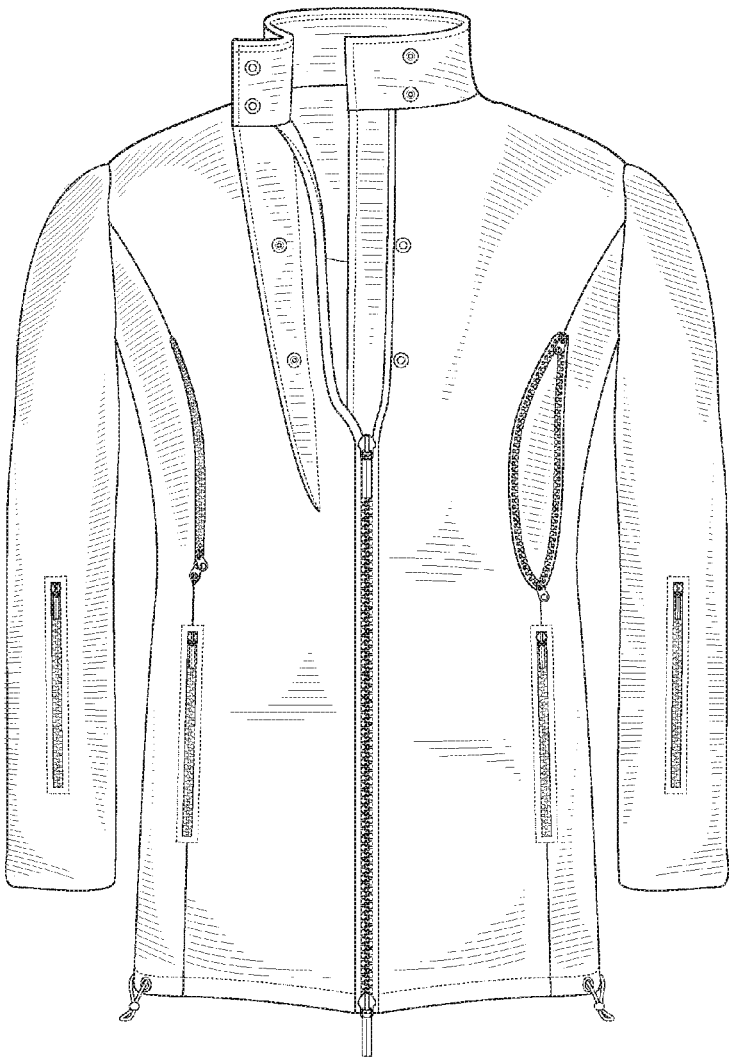
FIG. 10 is a front elevation of the garment illustrated in FIGS. 1 through 9 with the left front panel upper zipper open, exposing a left rear interior portion of the garment.

Similarly in FIG. 7, the portion of the garment visible through open right panel upper zipper 62 is denoted 214 and should be understood to represent a part of the rear lining of the garment, since there is no pocket associated with right front panel upper zipper 62, but rather the open right front panel upper zipper 62 provides an opening which is particularly suitably well adapted for the arms of an infant carried by the wearer of the garment. Similarly in FIG. 10, the open left front panel upper zipper 32 reveals inside lining portion 216 which is actually a portion of the inside lining of the garment on the wearer's right side.

Figure 11:
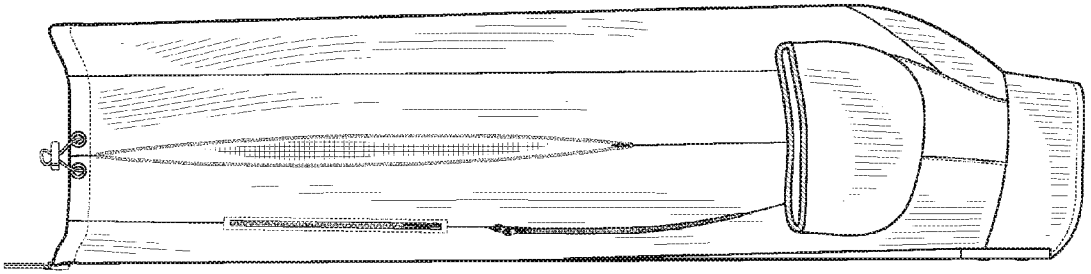
FIG. 11 is a broken sectional view taken at arrows 11-11 on FIG. 5 showing the fabric tunnel in which the garment drawstring resides, with the drawstring depicted therein.

FIG. 11 reveals how the waist drawstring 40 fits into drawstring tunnel 42 through an eyelet 218 secured in place in drawstring tunnel 42 in conventional push-together fashion, with eyelet 218 actually being two different donut-shaped pieces that interengage when pushed together to define the eyelet with a circular opening within it.

The exterior seams of the garment, such as seams 200, 202, 204, 206, 208 and 210, and other unnumbered exterior seams are preferably formed by overlock stitching.

Zippers such as left sleeve zipper 49, right side exterior panel zipper 52, and left side panel bisecting zipper 150 are preferably secured in place using straight stitching.

Figure 14:
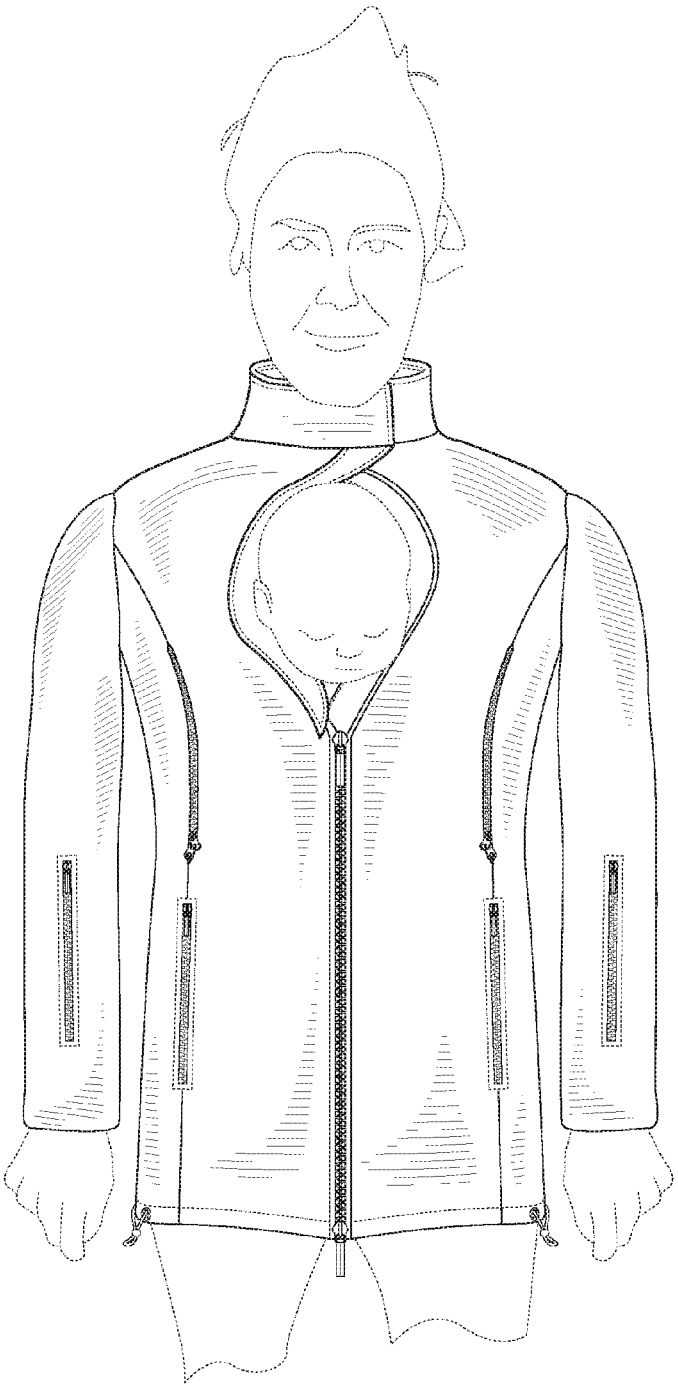
FIG. 14 is a front elevation of the garment illustrated in FIGS. 1 through 13 with the front zipper open, and with the left and right front, and the left and right sides, of the garment fully open, exposing the inside of the garment to view.
Figure 15:
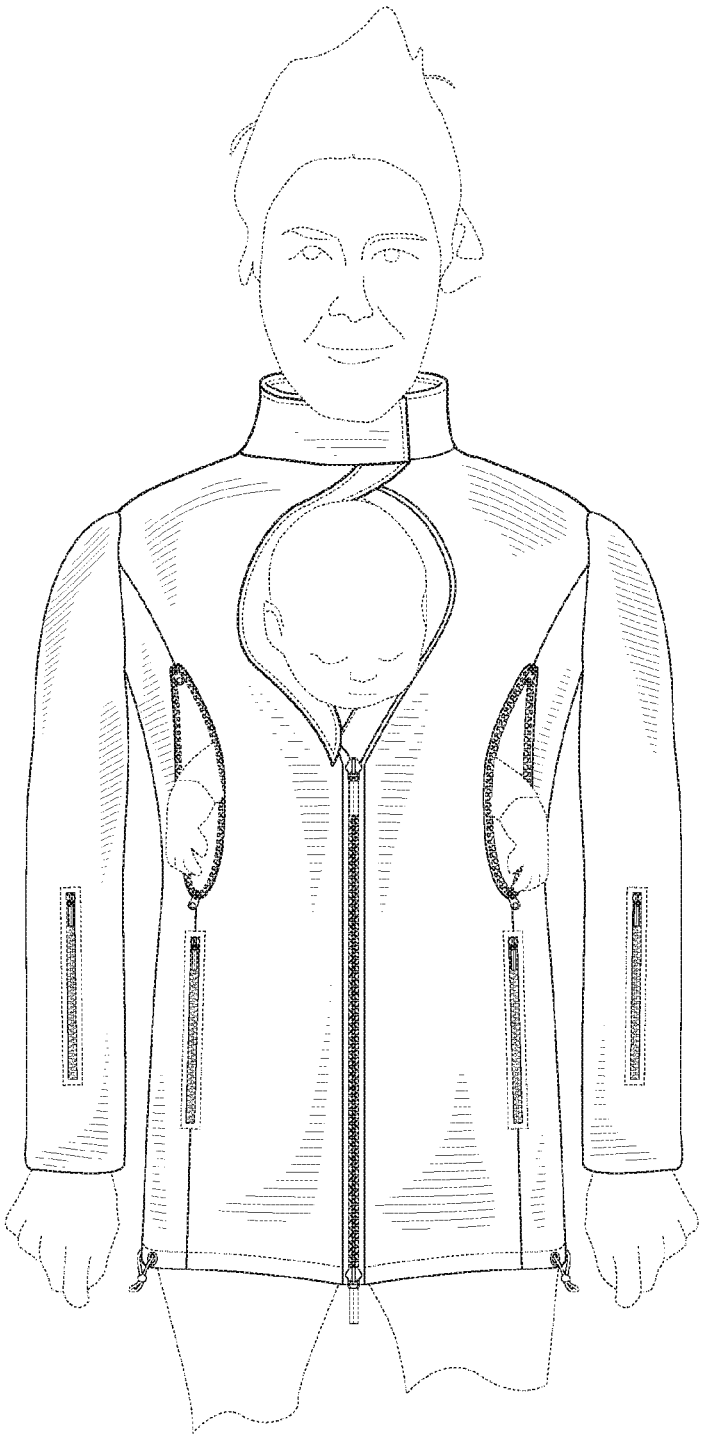
FIG. 15 is a front elevation of the garment illustrated in FIGS. 1 through 14 in use by an adult female carrying an infant, with the infant's head visible and with the front zipper up.

The overlock stitching used to secure seams 200, 202, as well as the seam 100 and seam 102, is clearly shown in FIG. 14 as are the left front panel upper zipper 32 and the right front panel upper zipper 62.

The straight stitching 220 used to finish the outer edge of collar 12 is shown schematically in FIG. 14, as is the straight stitching used to construct drawstring tunnel 42, where these stitchings have been respectively designated 220, 222.

Figure 2:
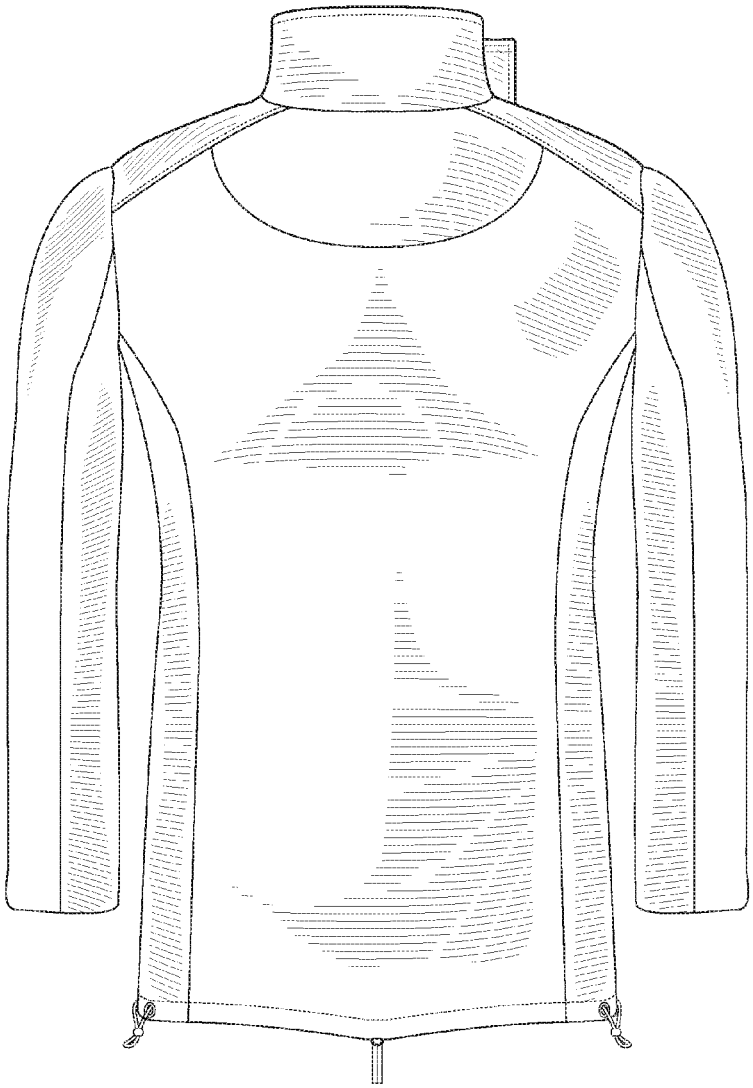
FIG. 2 is a rear elevation of the garment illustrated in FIG. 1.
Figure 3:
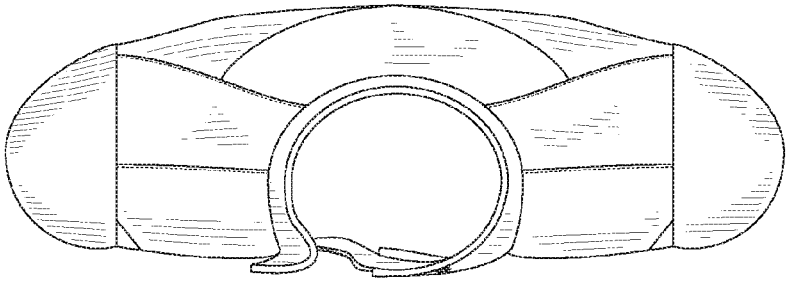
FIG. 3 is a top view of the garment illustrated in FIGS. 1 and 2.
Figure 4:
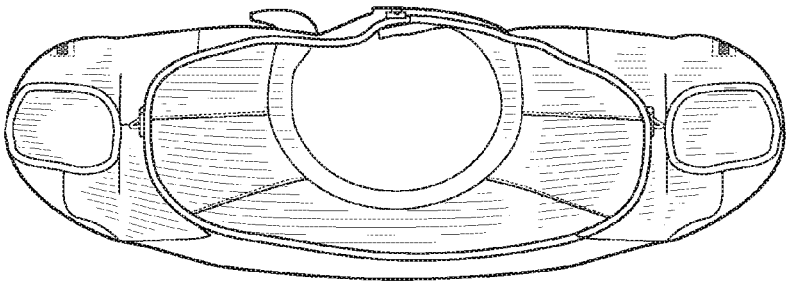
FIG. 4 is a bottom view of the garment illustrated in FIGS. 1, 2 and 3.
Figure 5:
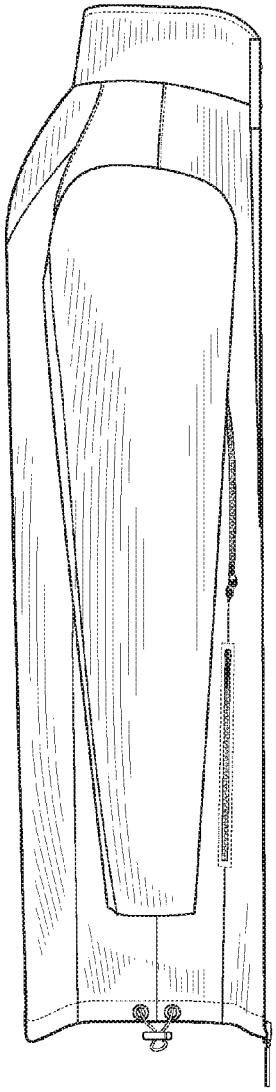
FIG. 5 is a right side elevation of the garment illustrated in FIGS. 1 through 4 with the right front panel upper and lower zippers closed.

Referring particularly to FIG. 14, there is visible overlock stitching 230 securing together rear neck cover panel 16 to rear exterior panel 18 to define seam 100, with seam 100 being best shown in FIG. 2. Similarly in FIG. 14, there is shown overlock stitching 226 securing left side panel 20 and rear panel 18 together thereby to define seam 200, with seam 200 being shown in FIG. 2. Further similarly, referring to FIG. 14, overlock stitching 228 as shown securing together right side panel 50 and rear panel 18, define seam 202 with seam 202 being shown in FIG. 2.

I claim the following:

1. An adjustable size garment for outdoor wear by adults, especially adapted for those adults carrying accompanying infants, with a frontal portion of the garment being adjustably enlargeable to fit around an infant carried by an adult on the upper torso of the adult wearing the garment, comprising:

a) a central portion adapted to fit about the adult's torso, the central portion generally having a front part comprising left and right front exterior panels, left and right side exterior panels and a back panel;

b) a drawstring positioned within a circumferential tunnel located at and within the lower extremity of the central portion adapted to encircle an entire waist of the adult when worn, for securing the central portion lower extremity about the torso of the adult wearing the garment;

c) a main zipper fitted in a front part of the central portion for optionally securing together generally vertically extending edges of the left and right front exterior panels of the central portion, the zipper extending from the lower extremity of the central portion to a position generally midway between the lower extremity of the central portion and an upper extremity of the central portion;

d) a collection of snap closures for detachably securing together generally vertically extending laterally overlapping edges of the left and right front exterior panels of the central portion, the snap closures being located between the upper extremity of the main zipper and the upper extremity of the central portion;

e) a first pair of closeable vertically extending openings, defining the entrances to respective pockets, positioned in seams joining vertically extending edges of respective left and right exterior front panels to edges of respective left and right side exterior panels;

f) a second pair of closeable vertically extending openings, defining passageways to the garment interior allowing hands of the infant to extend outside the garment when worn, positioned in seams joining vertically extending edges of respective left and right exterior front panels to edges of respective left and right side exterior panels, members of the second pair of closeable vertically extending openings being spaced from and above the members of the first pair of closeable vertically extending openings;

g) a pair of sleeves extending downwardly from the upper extremity of the central portion, to accommodate the arms of the adult wearing the garment;

h) vertically oriented size-adjusting zippers extending continuously from the lower extremity of the central portion upwardly under the sleeves towards juncture of the respective sleeve and the central portion;

i) flexible side expansion panels connected to the central portion interior on both sides of respective ones of the size-adjusting zippers and extending continuously upwardly the vertical length of the size adjusting zippers, the expansion panels being of a preselected width to control the extent to which the garment may be size adjusted to accommodate adults of varying size by adjusting closure of the respective size-adjusting zippers;

j) pairs of zippers positioned facing forwardly and extending longitudinally along respective sleeves, defining entrances to respective pockets located in respective sleeves;

k) spring-loaded pushbutton retainers for adjusting length of the drawstring;

l) eyelets formed in the central tunnel for passage therethrough of the drawstring to connect with the spring loaded pushbuttons; and m) an exterior of the central portion being a first color and the expansion panels being a second color contrasting with the first color.

2. The garment of claim 1 wherein the expansion panels are fabric.

3. The garment of claim 2 wherein the fabric is stretchable.

4. The garment of claim 2 further comprising overlock stitching securing a rear neck panel of the central portion to the back panel to define a seam therebetween.

5. The garment of claim 2 further comprising overlock stitching securing a right side exterior panel to the back panel of the central portion to define a seam therebetween and overlock stitching securing a left side exterior panel to the back panel of the central portion to define a seam therebetween.

6. The garment of claim 2 further comprising straight stitching connecting a bottom edge of the central portion to a part of the central portion above the bottom edge to define the circumferential tunnel.

7. The garment of claim 2 wherein the fabric is elastic.

8. The garment of claim 7 further comprising overlock stitching securing a rear neck panel of the central portion to the back panel to define a seam therebetween.

9. The garment of claim 8 further comprising overlock stitching securing a right side exterior panel to the back panel of the central portion to define a seam therebetween and overlap stitching securing a left side exterior panel to the back panel of the central portion to define a seam therebetween.

10. The garment of claim 9 further comprising straight stitching connecting a bottom edge of the central portion to a part of the central portion above the bottom edge to define the circumferential tunnel.

11. The garment of claim 1 wherein the expansion panels are elastic.

12. The garment of claim 1 further comprising overlock stitching securing a rear neck panel of the central portion to the back panel to define a seam therebetween.

13. The garment of claim 1 further comprising overlock stitching securing a right side exterior panel to the back panel of the central portion to define a seam therebetween and overlock stitching securing a left side exterior panel to the back panel of the central portion to define a seam therebetween.

14. The garment of claim 1 further comprising straight stitching connecting a bottom edge of the central portion to a part of the central portion above the bottom edge to define the circumferential tunnel.

15. A garment for outdoor wear, being adjustably enlargeable to fit about a girth of a wearer, comprising:

a) a central portion adapted to fit about an adult's torso having a front part comprising left and right front exterior panels, left and right side exterior panels and a back panel, the central portion having a pair of vertically extending zippered openings therein running along seams of the central portion respective of the right and left exterior panels, providing access to the garment interior;

b) a zipper fitted in a front part of the central portion for optionally securing together a generally vertically extending edges of the left and right front exterior panels of the central portion, the zipper extending center edges of the central portion continuously to a position generally midway between the lower extremity of the central portion and an upper extremity of the central portion;

c) a collection of snap closures for detachably securing together generally vertically extending laterally overlapping central edges of the central portion, the snap closures being located between the upper extremity of the main zipper and upper extremity of the central portion;

d) a pair of sleeves extending downwardly from the upper extremity of the central portion, to accommodate the arms of the adult wearing the garment;

e) vertically oriented size-adjusting zippers extending continuously from the lower extremity of the central portion upwardly under the sleeves to juncture of the respective sleeve and the central portion;

f) linings connected to the central portion interior on both sides of respective ones of the size-adjusting zippers and extending upwardly continuously along the vertical length of the size adjusting zippers, the linings being of a preselected width to control the extent to which the garment may be size adjusted to accommodate adults of varying size by adjusting closure of the respective size-adjusting zippers;

g) a second pair of closeable vertically extending openings, defining passageways to the garment interior, positioned in seams joining vertically extending edges of respective left and right exterior front panels to edges of respective left and right side exterior panels, members of the second pair of closeable vertically extending openings being spaced from and above the members of the first pair of closeable vertically extending openings.

16. The garment of claim 15 further comprising:

a) a drawstring positioned within a circumferential tunnel located at and within the lower extremity of the central portion, for securing the central portion lower extremity about the torso of the adult wearing the garment.

17. A garment for outdoor wear, being adjustably enlargeable to fit about a girth of a wearer, comprising:

a) a central portion adapted to fit about the adult's torso having a front part comprising left and right front exterior panels, left and right side exterior panels and a back panel, the central portion having a pair of vertically extending zippered openings therein, providing access to the garment interior, the central portion comprising respective side panels;

b) sleeves extending downwardly from the upper extremity of the central portion, to accommodate the arms of the adult wearing the garment;

c) vertically oriented size-adjusting closures extending along a seam from the lower extremity of the central portion upwardly under the sleeves, when closed defining said respective side panels to have first width and when open exposing fabric defining said respective side panels to have second width greater than the first width, thereby allowing the garment to be worn by a person unable to fit into the garment with the side-adjusting closures closed; and d) said fabric connected to the central portion interior on both sides of respective ones of the size adjusting closures and continuously extending along the vertical length of the size adjusting closures, the fabric being of a preselected width to control the extent to which the garment may be size-adjusted to accommodate adults of varying size girth by adjustment of the respective size-adjusting closures;

e) a first pair of closeable vertically extending openings, defining the entrances to respective pockets, positioned in seams joining vertically extending edges of respective left and right exterior front panels to edges of respective left and right side exterior panels;

f) a second pair of closeable vertically extending openings, defining passageways to the garment interior, positioned in seams joining vertically extending edges of respective left and right exterior front panels to edges of respective left and right side exterior panels, members of the second pair of closeable vertically extending openings being spaced from and above the members of the first pair of closeable vertically extending openings.

18. An adjustable size garment for outdoor wear by adults, especially adapted for those adults carrying accompanying infants, with a frontal portion of the garment being adjustably enlargeable to fit around an infant carried by an adult on the upper torso of the adult wearing the garment, comprising:

a) a central portion adapted to fit about the adult's torso, the central portion generally having a front part comprising left and right front exterior panels, left and right side exterior panels and a back panel;

b) a drawstring positioned within a circumferential tunnel located at and within the lower extremity of the central portion adapted to encircle an entire waist of the adult when worn, for securing the central portion lower extremity about the torso of the adult wearing the garment;

c) a main zipper fitted in a front part of the central portion for optionally securing together generally vertically extending edges of the left and right front exterior panels of the central portion, the zipper extending from the lower extremity of the central portion to a position generally midway between the lower extremity of the central portion and an upper extremity of the central portion;

d) a collection of snap closures for detachably securing together generally vertically extending laterally overlapping edges of the left and right front exterior panels of the central portion, the snap closures being located between the upper extremity of the main zipper and the upper extremity of the central portion;

e) a first pair of closeable vertically extending openings, defining the entrances to respective pockets, positioned in seams joining vertically extending edges of respective left and right exterior front panels to edges of respective left and right side exterior panels;

f) a second pair of closeable vertically extending openings, defining passageways to the garment interior allowing hands of the infant to extend outside the garment when worn, in seams joining vertically extending edges of respective left and right exterior front panels to edges of respective left and right side exterior panels, members of the second pair of closeable vertically extending openings being spaced from and above the members of the first pair of closeable vertically extending openings;

g) vertically oriented size-adjusting zippers extending continuously upwardly from the lower extremity of the central portion located on the right and left side exterior panels;

h) flexible side expansion panels connected to the central portion interior on both sides of respective ones of the size-adjusting zippers and extending continuously the vertical length of the size adjustable zippers, the expansion panels being of a preselected width to control the extent to which the garment may be size adjusted to accommodate adults of varying size by adjusting closure of the respective size-adjusting zippers;

i) spring-loaded pushbutton retainers for adjusting length of the drawstring;

j) eyelets formed in the central tunnel for passage therethrough of the drawstring to connect with the spring loaded pushbuttons; and k) the exterior of the central portion being a first color and the expansion panels being a second color contrasting with the first color.

19. A garment for outdoor wear, being adjustably enlargeable to fit about a girth of a wearer, comprising:

a) a central portion adapted to fit about an adult's torso, the central portion having a pair of vertically extending openings therein, providing access to the garment interior and having a front part comprising left and right front exterior panels, left and right side exterior panels and a back panel;

b) vertically oriented size-adjusting zippers upwardly extending from the lower extremity of the central portion;

c) linings connected to the central portion interior on both sides of respective ones of the size-adjusting zippers and extending continuously the vertical height of the size adjusting zippers, the linings being of a preselected width to control the extent to which the garment may be size adjusted to accommodate adults of varying size by adjusting closure of the respective size-adjusting zippers;

d) a first pair of closeable vertically extending openings, defining the entrances to respective pockets, positioned in seams joining vertically extending edges of respective left and right exterior front panels to edges of respective left and right side exterior panels;

e) a second pair of closeable vertically extending openings, defining passageways to the garment interior, positioned in seams joining vertically extending edges of respective left and right exterior front panels to edges of respective left and right side exterior panels, members of the second pair of closeable vertically extending openings being spaced from and above the members of the first pair of closeable vertically extending openings.

20. An adjustable size garment for outdoor wear by adults, especially adapted for those adults carrying accompanying infants, with a frontal portion of the garment being adjustably enlargeable to fit around an infant carried on an upper torso of the adult wearing the garment, consisting of:

a) a central portion adapted to fit about an adult's torso, the central portion generally having a front part comprising left and right front exterior panels, left and right side exterior panels and a back panel;

b) a drawstring positioned within a circumferential tunnel located at and within the lower extremity of the central portion adapted to encircle an entire waist of the adult when worn, for securing the central portion lower extremity about the torso of the adult wearing the garment;

c) a main zipper fitted in a front part of the central portion for optionally securing together generally vertically extending edges of the left and right front exterior panels of the central portion, the zipper extending from the lower extremity of the central portion to a position generally midway between the lower extremity of the central portion and an upper extremity of the central portion;

d) a collection of snap closures for detachably securing together generally vertically extending laterally overlapping edges of the left and right front exterior panels of the central portion, the snap closures being located between the upper extremity of the main zipper and upper extremity of the central portion;

e) a first pair of closeable vertically extending openings, defining the entrances to respective pockets, positioned in seams joining vertically extending edges of respective left and right exterior front panels to edges of respective left and right side exterior panels;

f) a second pair of closeable vertically extending openings, defining passageways to the garment interior allowing hands of the infant to extend outside the garment when worn, positioned in seams joining vertically extending edges of respective left and right exterior front panels to edges of respective left and right side exterior panels, members of the second pair of closeable vertically extending openings being spaced from and above the members of the first pair of closeable vertically extending openings;

g) a pair of sleeves extending downwardly from the upper extremity of the central portion, to accommodate the arms of the adult wearing the garment;

h) vertically oriented size-adjusting zippers extending continuously from the lower extremity of the central portion upwardly under the sleeves towards juncture of the respective sleeve and the central portion;

i) flexible side expansion panels connected to the central portion interior on both sides of respective ones of the size-adjusting zippers and extending continuously the vertical length of the size adjusting zippers, the expansion panels being of a preselected width to control the extent to which the garment may be size adjusted to accommodate adults of varying size by adjusting closure of the respective size-adjusting zippers;

j) pairs of zippers positioned facing forwardly and extending longitudinally along respective sleeves, defining entrances to respective pockets located in respective sleeves;

k) spring-loaded pushbutton retainers for adjusting length of the drawstring;

l) eyelets formed in the central tunnel for passage therethrough of the drawstring to connect with the spring loaded pushbuttons;

m) overlock stitching securing a rear neck panel of the central portion to the back panel to define a seam therebetween;

n) overlock stitching securing a right side exterior panel to the back panel of the central portion to define a seam therebetween and overlap stitching securing a left side exterior panel to the back panel of the central portion to define a seam therebetween;

o) straight stitching connecting a bottom edge of the central portion to a part of the central portion above the bottom edge to define the circumferential tunnel.

21. An adjustable size garment for outdoor wear by adults, especially adapted for those adults carrying accompanying infants, with a frontal portion of the garment being adjustably enlargeable either to fit around an infant carried by an adult on the upper torso of the adult wearing the garment or to accommodate an adult wearer of the garment whose girth has changed due to gain or loss of weight, comprising:

a) a central portion adapted to fit about an adult's torso, the central portion generally having a front part comprising left and right front exterior panels, left and right side exterior panels and a back panel with overlock stitching securing the right side exterior panel to the back panel to define a seam therebetween and overlock stitching securing a left side exterior panel to the back panel to define a seam therebetween;

b) a drawstring positioned within a circumferential tunnel located at and within the lower extremity of the central portion, for securing the central portion lower extremity about the torso of an adult wearing the garment with straight stitching connecting a bottom edge of the central portion to a part of the central portion above the bottom edge to define the circumferential tunnel;

c) a main zipper fitted in a front part of the central portion for optionally securing together generally vertically extending edges of the left and right front exterior panels of the central portion, the zipper extending from the lower extremity of the central portion to a position generally midway between the lower extremity of the central portion and an upper extremity of the central portion;

d) a collection of snap closures for detachably securing together generally vertically extending laterally overlapping edges of the left and right front exterior panels of the central portion, the snap closures being located between the upper extremity of the main zipper and upper extremity of the central portion;

e) a first pair of closeable vertically extending openings, defining the entrances to respective pockets, positioned in seams joining vertically extending edges of respective left and right exterior front panels to edges of respective left and right side exterior panels;

f) a second pair of closeable vertically extending openings, defining passageways to the garment interior, positioned in seams joining vertically extending edges of respective left and right exterior front panels to edges of respective left and right side exterior panels, members of the second pair of closeable vertically extending openings being spaced from and above the members of the first pair of closeable vertically extending openings;

g) a pair of sleeves extending downwardly from the upper extremity of the central portion, to accommodate the arms of a person wearing the garment;

h) vertically oriented size-adjusting zippers extending continuously from the lower extremity of the central portion upwardly under the sleeves towards juncture of the respective sleeve and the central portion;

i) flexible side fabric expansion panels connected to the central portion interior on both sides of respective ones of the size-adjusting zippers and extending continuously upwardly the vertical length of the size adjusting zippers, the expansion panels being of a preselected width to control the extent to which the garment may be size adjusted to accommodate adults of varying size by adjusting closure of the respective size-adjusting zippers;

j) pairs of zippers positioned facing forwardly and extending longitudinally along respective sleeves, defining entrances to respective pockets located in respective sleeves;

k) spring-loaded pushbutton retainers for adjusting length of the drawstring;

l) eyelets formed in the central tunnel for passage therethrough of the drawstring to connect with the spring loaded pushbuttons; and m) overlock stitching securing a rear neck panel of the central portion to the back panel to define a seam therebetween.

* * * * *